US009463122B2

(12) United States Patent
Pirone et al.

(10) Patent No.: US 9,463,122 B2
(45) Date of Patent: Oct. 11, 2016

(54) WHEELED LIFTING DEVICE

(71) Applicants: Thomas A. Pirone, Danbury, CT (US); Thomas A. Pirone, Redding, CT (US)

(72) Inventors: Thomas A. Pirone, Redding, CT (US); Christopher Jaeger, Southbury, CT (US)

( * ) Notice: Subject to any disclaimer, the term of this patent is extended or adjusted under 35 U.S.C. 154(b) by 0 days.

(21) Appl. No.: 14/596,760

(22) Filed: Jan. 14, 2015

(65) Prior Publication Data

US 2015/0196440 A1 Jul. 16, 2015

Related U.S. Application Data

(60) Provisional application No. 61/927,595, filed on Jan. 15, 2014, provisional application No. 62/038,545, filed on Aug. 18, 2014.

(51) Int. Cl.

| | |
|---|---|
| ***A61G 5/06*** | (2006.01) |
| ***A61G 5/10*** | (2006.01) |
| *A61G 5/04* | (2013.01) |

(52) U.S. Cl.

CPC ..... *A61G 5/104* (2013.01); *A61G 5/047* (2013.01); *A61G 2005/1051* (2013.01); *Y10T 16/182* (2015.01)

(58) Field of Classification Search

None

See application file for complete search history.

(56) References Cited

U.S. PATENT DOCUMENTS

| | | | | |
|---|---|---|---|---|
| 3,845,933 | A | 11/1974 | Heizer, Jr. | |
| 4,290,423 | A * | 9/1981 | Kleinwolterink | A61G 7/1017 5/83.1 |
| 4,432,425 | A | 2/1984 | Nitzberg | |
| 4,455,029 | A | 6/1984 | Taylor | |
| 4,483,405 | A * | 11/1984 | Noda et al. | 180/6.5 |
| 4,512,439 | A * | 4/1985 | Howell | E06C 5/04 182/208 |
| 4,886,288 | A * | 12/1989 | Dysarz | 280/250.1 |
| 4,962,942 | A | 10/1990 | Barnett et al. | |
| 5,613,697 | A | 3/1997 | Johnson | |
| 5,690,185 | A * | 11/1997 | Sengel | 180/65.1 |
| 5,826,670 | A | 10/1998 | Nan | |
| 6,155,583 | A | 12/2000 | Koike | |
| 6,325,399 | B1 | 12/2001 | DeMoss | |
| 6,419,260 | B1 | 7/2002 | Kuroda | |
| 6,793,232 | B1 | 9/2004 | Wing | |
| 7,040,641 | B2 | 5/2006 | Wing | |
| 7,063,344 | B2 * | 6/2006 | Pichette | 280/304.1 |
| 7,281,724 | B1 | 10/2007 | Larson | |

(Continued)

FOREIGN PATENT DOCUMENTS

| | | | |
|---|---|---|---|
| WO | 2004/047709 | A1 | 6/2004 |
| WO | WO 2004047709 | A1 * | 6/2004 |

*Primary Examiner* — John Walters
*Assistant Examiner* — Hilary L Johns
(74) *Attorney, Agent, or Firm* — Ware, Fressola, Maguire & Barber LLP

(57) ABSTRACT

The present invention is directed to a wheeled lifting device that is configured for positioning between an extended configuration and a retracted configuration and adapted for attachment to a wheeled or non-wheeled device. In the extended configuration, the wheeled lifting device is configured to allow for multi-directional movement of the wheeled or non-wheeled device. The wheeled lifting device may include an extension mechanism and at least one multi-directional wheel, where the extension mechanism is configured to move the wheeled lifting device between the retracted configuration and the extended configuration. The extension mechanism can include a mechanical mechanism, a hydraulic mechanism or a pneumatic mechanism.

13 Claims, 63 Drawing Sheets

(56) References Cited

U.S. PATENT DOCUMENTS 7,374,002 B2 5/2008 Fought
7,549,703 B2 6/2009 McElhinney
7,644,932 B2 1/2010 Heng
7,931,300 B2 4/2011 Mulhern et al.

* cited by examiner

WHEELED LIFTING DEVICE

CROSS-REFERENCE TO RELATED APPLICATIONS

This application claims priority to U.S. Provisional Application No. 61/927,595 filed Jan. 15, 2014 and U.S. Provisional Application No. 62/038,545 filed Aug. 18, 2014, which are both herein incorporated by reference in their entireties.

BACKGROUND OF THE INVENTION

1. Field of the Invention

The present invention generally relates to wheeled lifting devices, and more particularly relates to a wheeled lifting device that is configured to increase the mobility of another wheeled or non-wheeled device by providing for movement of the device in additional directions, an example of another wheeled device on which the wheeled lifting device may be suited is a wheelchair.

2. Description of Related Art

Many wheeled devices, such as wheelchairs, are configured for movement along a single direction, and cannot be easily moved in multi-directions or in tight spaces due to their limited turning abilities. Wheelchairs that may be configured for multi-directional movement may not be suitable in all circumstances, due to their complexity and or costs. Furthermore, multi-directional wheelchairs may also have movement limitations as a result of the requirement that they can simultaneously travel in many directions. Therefore, it is desirable to combine the advantages attendant upon standard wheelchairs, with those present in multi-directional wheelchairs in order to provide a versatile wheeled device that is adaptable to a variety of different situations and/or environments.

SUMMARY OF THE INVENTION

The present invention is designed to overcome the above noted limitations that are attendant upon the use of conventional wheelchairs and, toward this end, it contemplates the provision of a novel wheeled lifting device.

It is an object of the present invention to provide a wheeled lifting device that is configured to allow for selective multi-directional movement of a wheeled device, such as a wheelchair.

It is another object of the present invention to provide a wheeled lifting device that is configured to selectively facilitate increased mobility of a wheeled device, such as a wheelchair.

It is yet another object of the present invention to provide a wheeled lifting device that is configured to selectively increase the turning ability of a wheeled device, such as a wheelchair.

The present invention is directed to a wheeled lifting device that is configured for positioning between an extended configuration and a retracted configuration and adapted for attachment to a wheeled or non-wheeled device. In the extended configuration, the wheeled lifting device is configured to allow for multi-directional movement of the wheeled or non-wheeled device. The wheeled lifting device may include an extension mechanism and at least one multi-directional wheel, where the extension mechanism is configured to move the wheeled lifting device between the retracted configuration and the extended configuration. The extension mechanism can include a mechanical mechanism, a hydraulic mechanism or a pneumatic mechanism.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1:
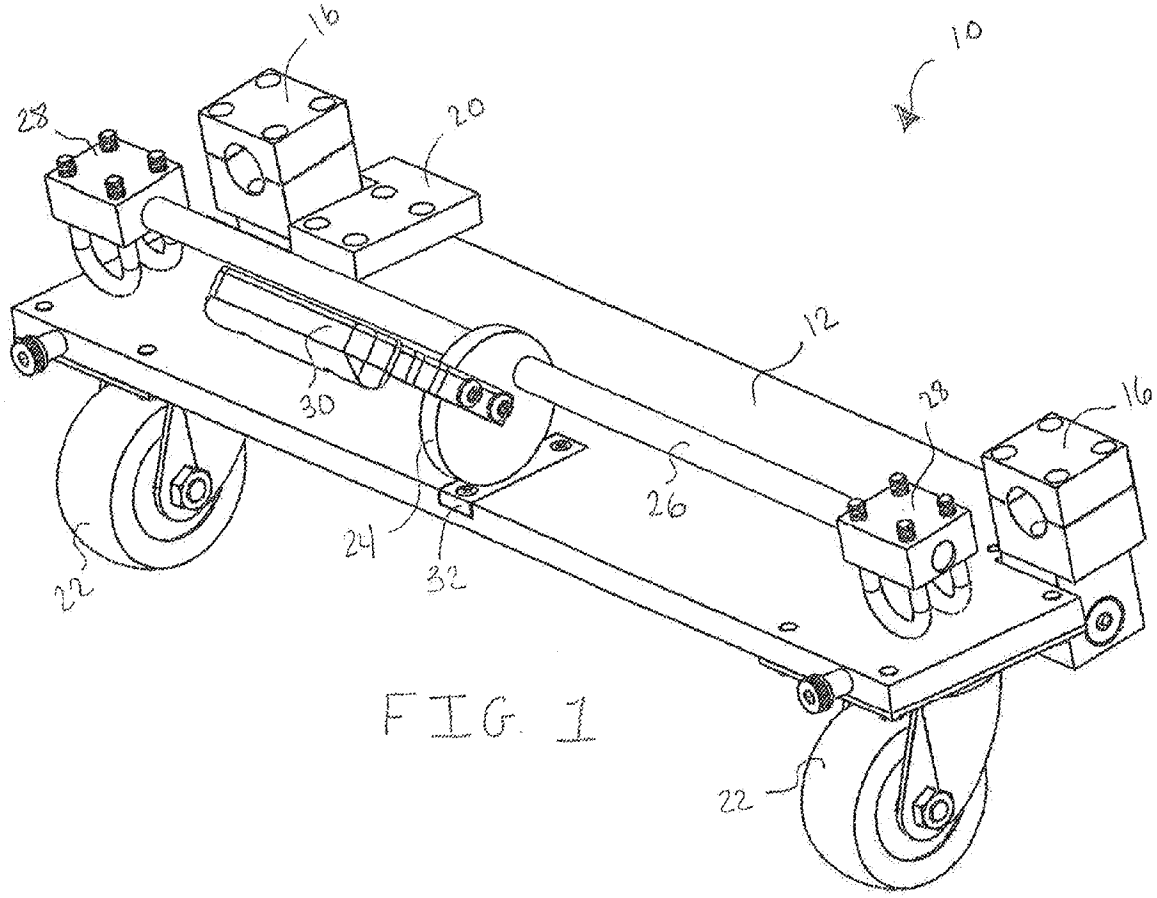
FIG. 1 is an isometric view of an exemplary wheeled lifting device in a retracted configuration according to the present invention.
Figure 2:
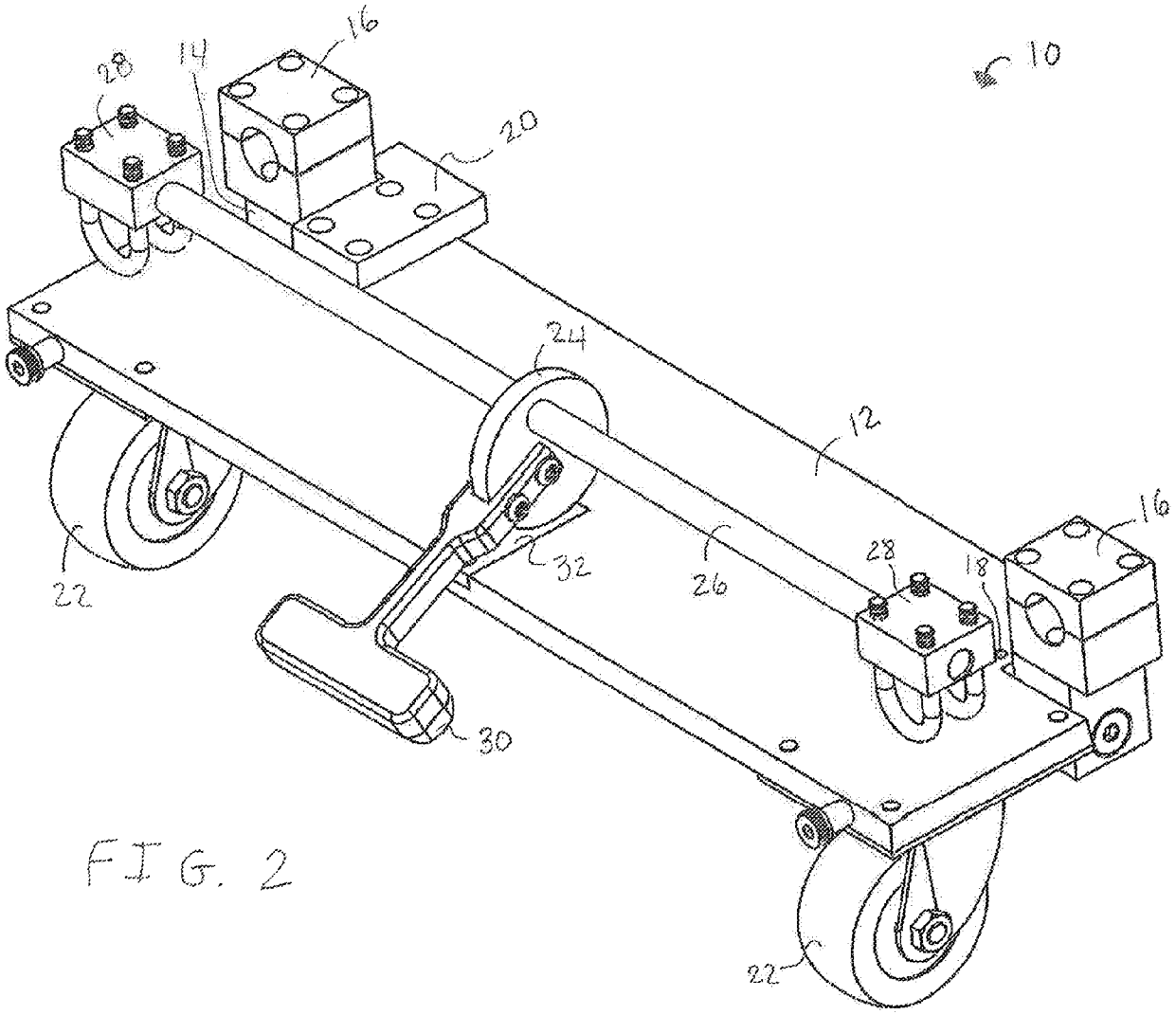
FIG. 2 is an isometric view of the exemplary wheeled lifting device in an extended configuration according to the present invention.
Figure 3:
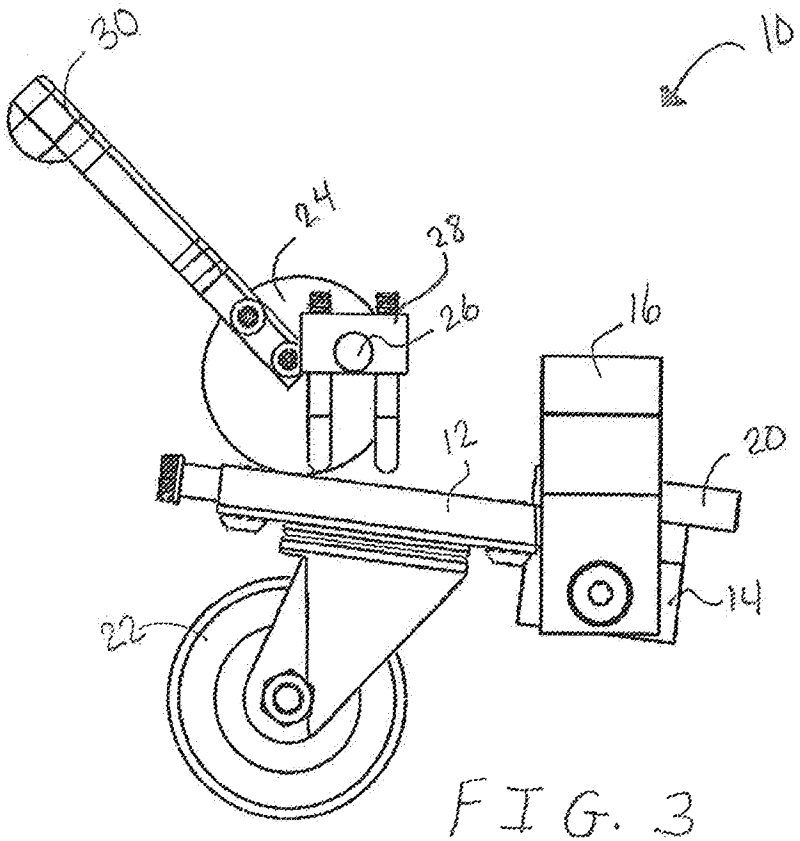
FIG. 3 is side view of the exemplary wheeled lifting device in a retracted configuration according to the present invention.
Figure 4:
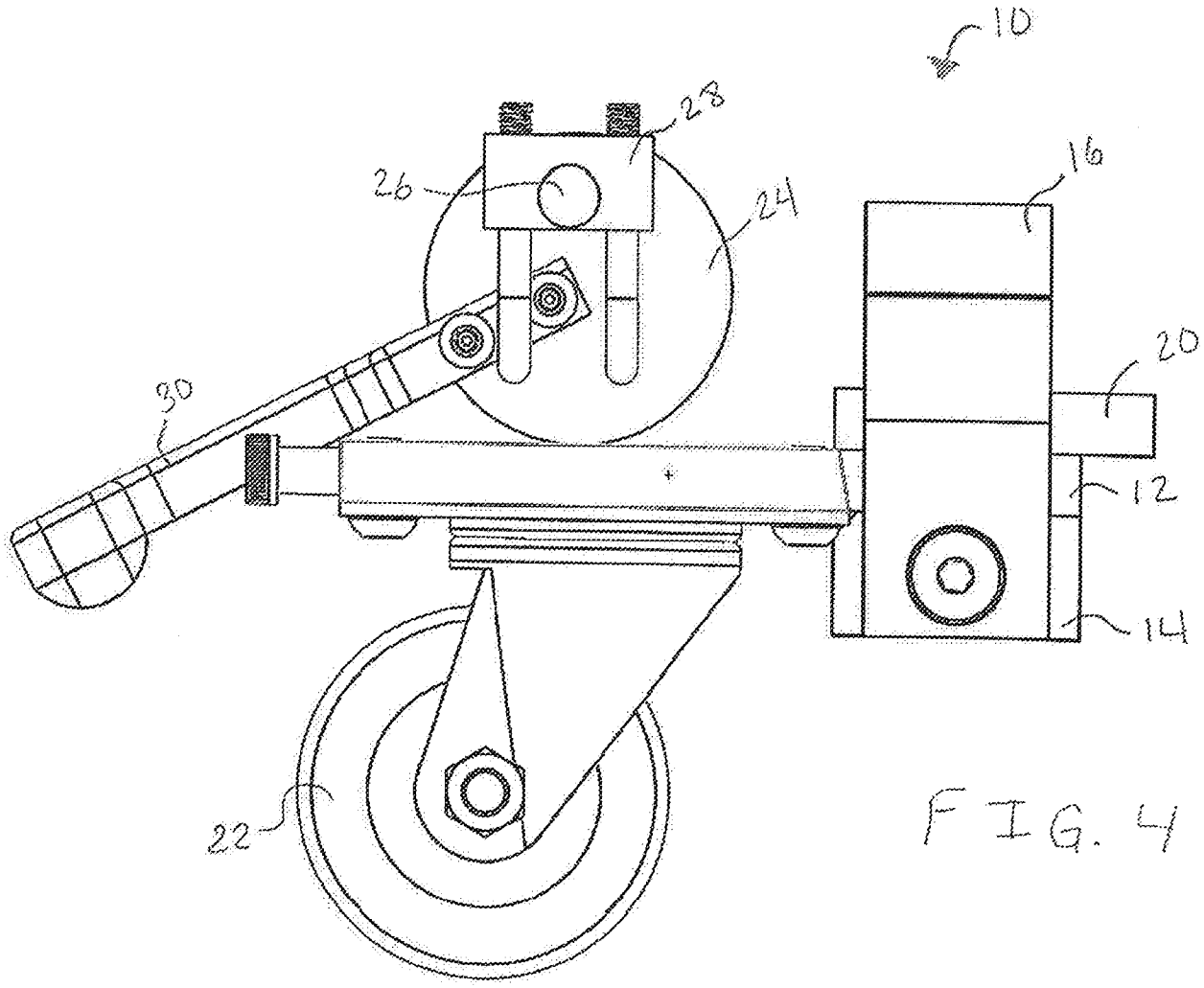
FIG. 4 is a side view of the exemplary wheeled lifting device in extended configuration according to the present invention.
Figure 5:
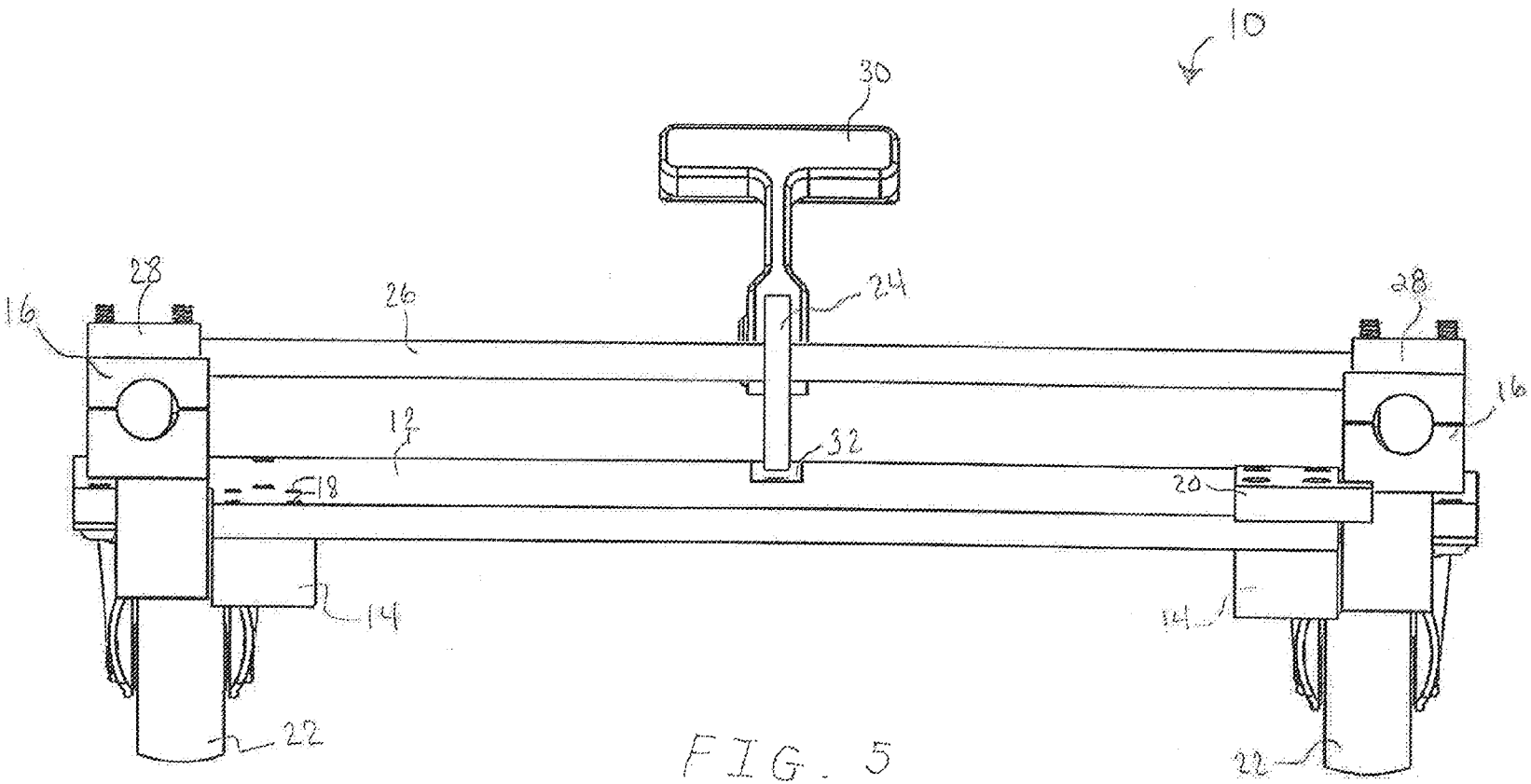
FIG. 5 is a front view of the exemplary wheeled lifting device in a retracted configuration according to the present invention.
Figure 6:
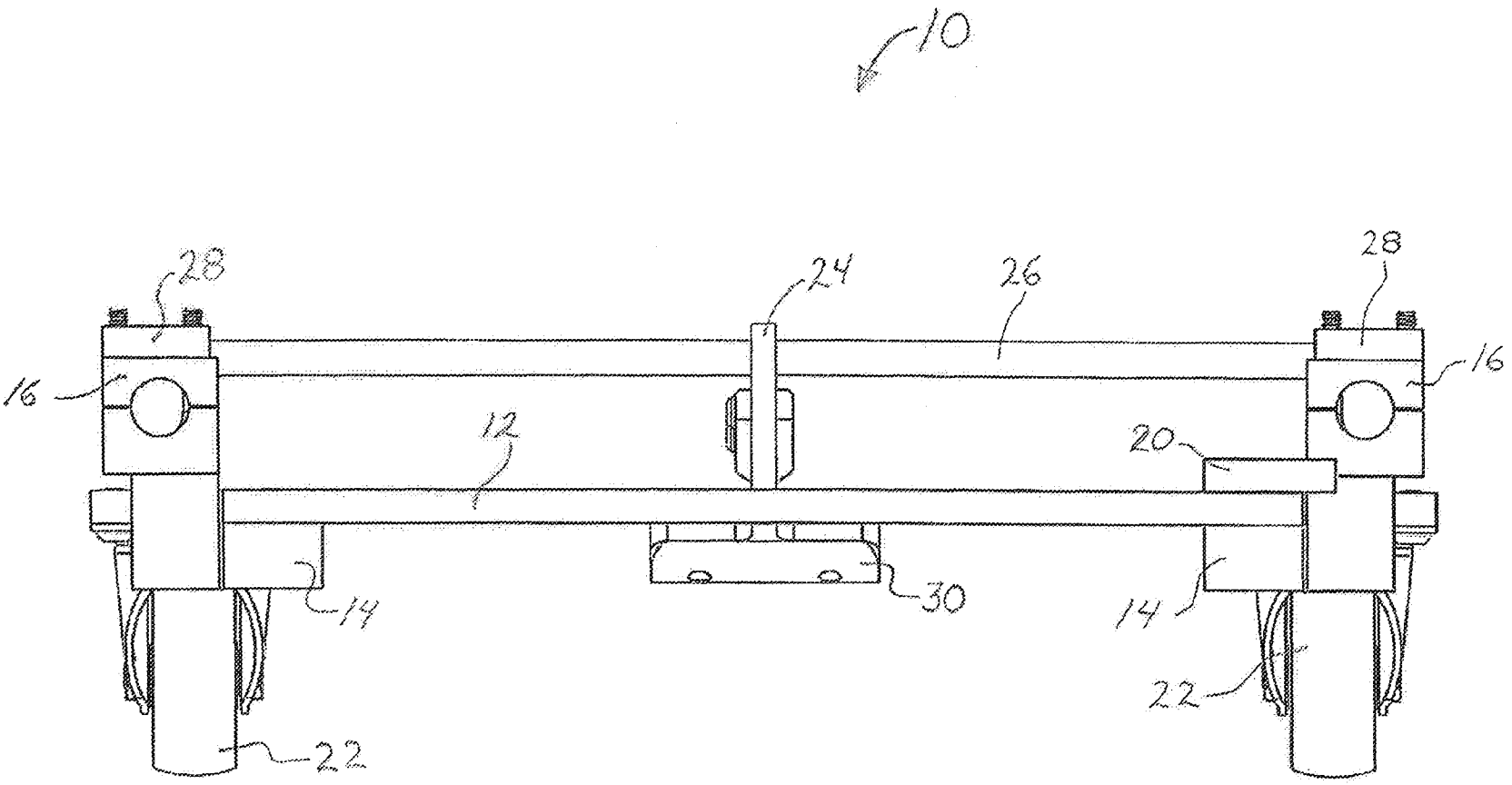
FIG. 6 is a front view of the exemplary wheeled lifting device in an extended configuration according to the present invention.
Figure 7:
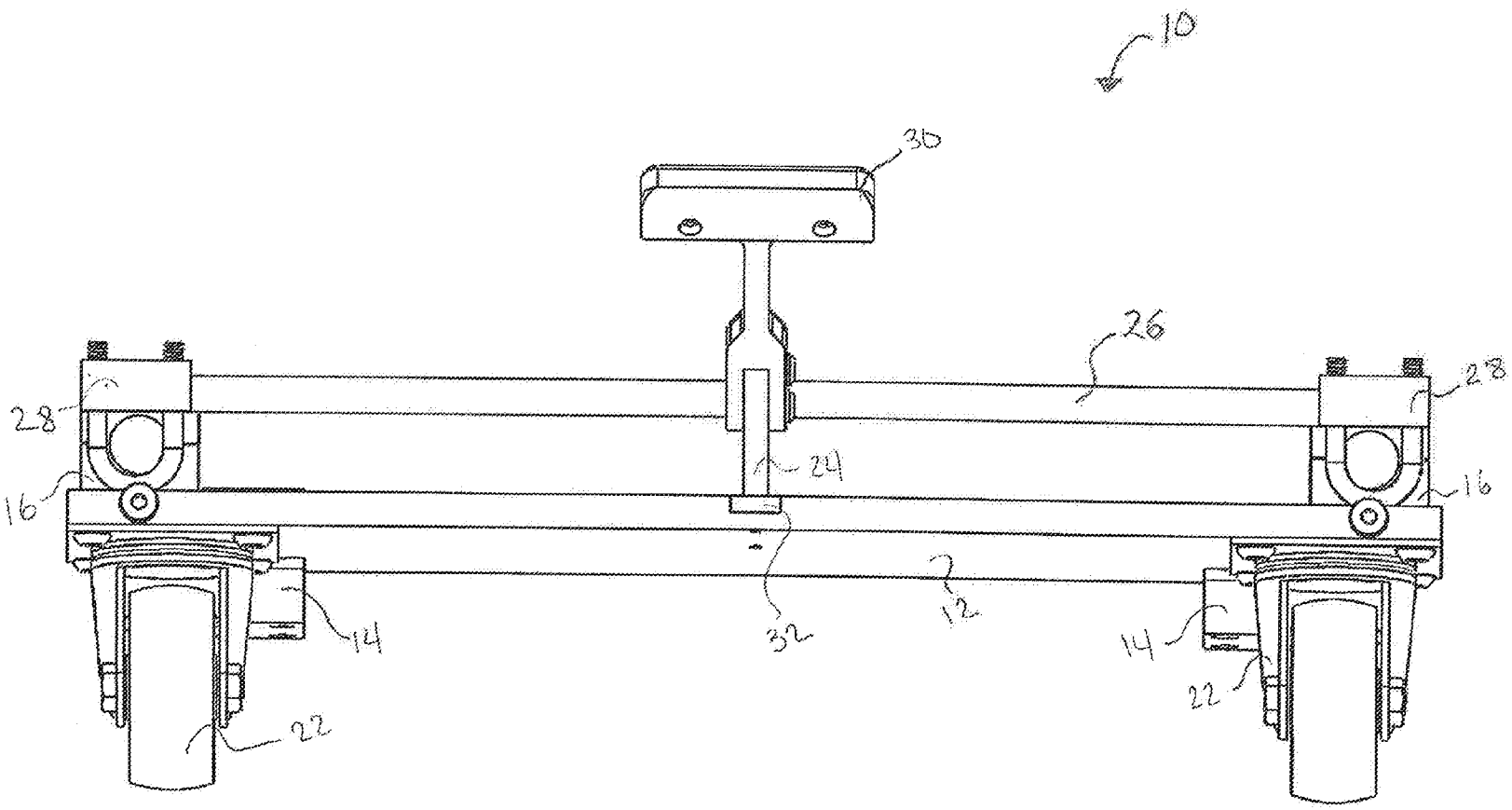
FIG. 7 is a rear view of the exemplary wheeled lifting device in a retracted configuration according to the present invention.
Figure 8:
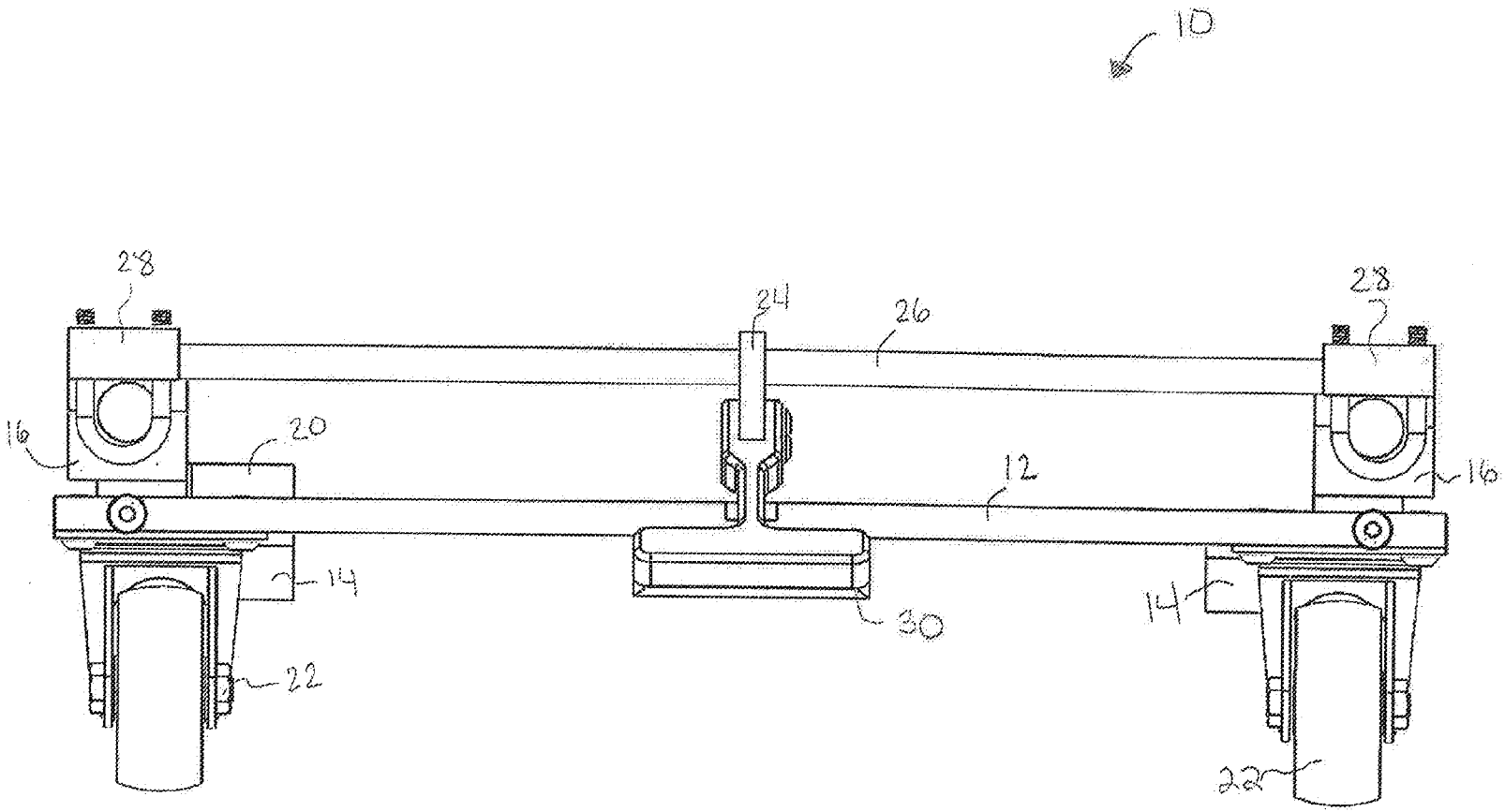
FIG. 8 is a rear view of the exemplary wheeled lifting device in an extended configuration according to the present invention.
Figure 9:
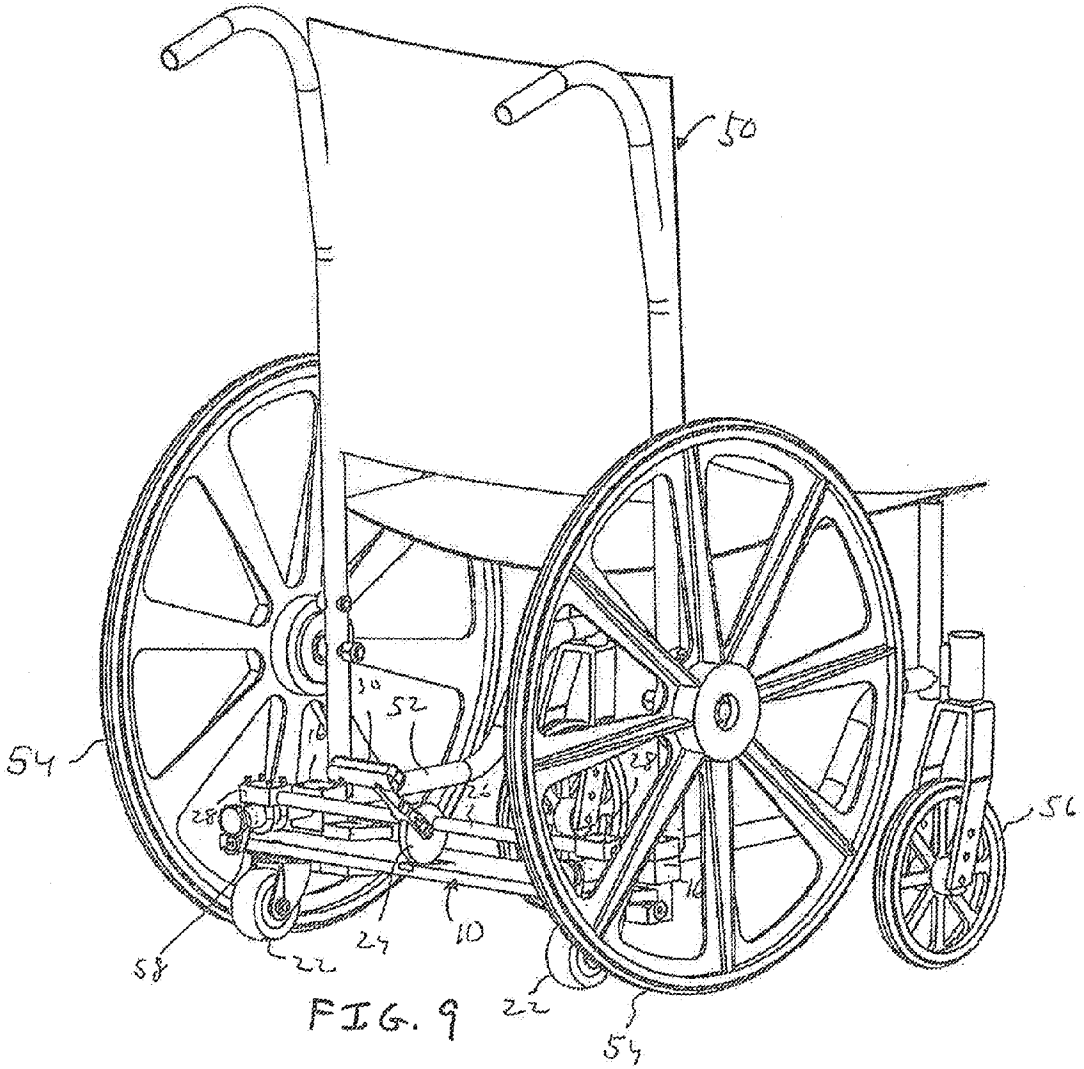
FIG. 9 is a rear isometric view of the exemplary wheeled lifting device in a retracted configuration installed on an exemplary wheelchair.
Figure 9A:
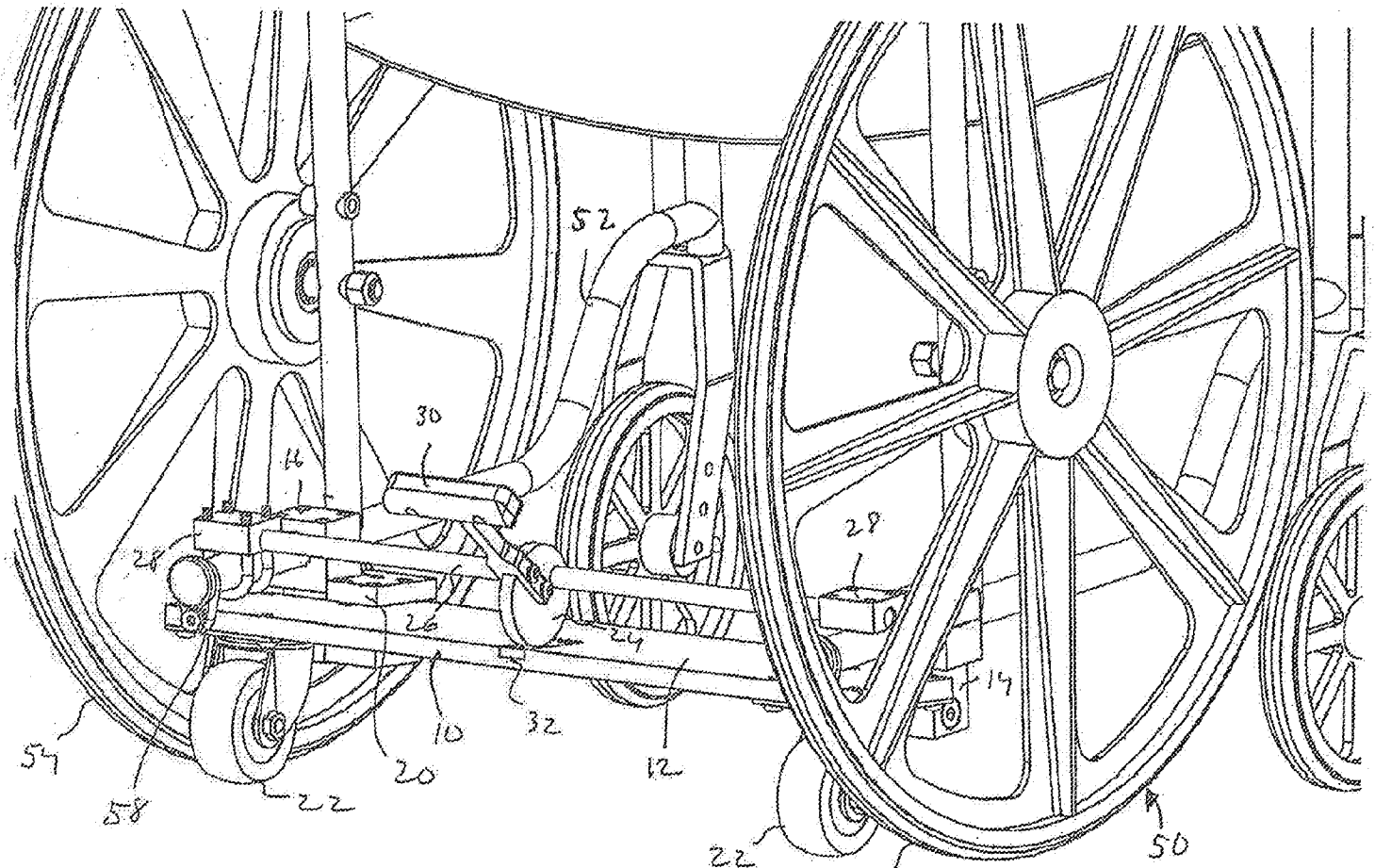
FIG. 9A is an expanded view of FIG. 9.
Figure 10:
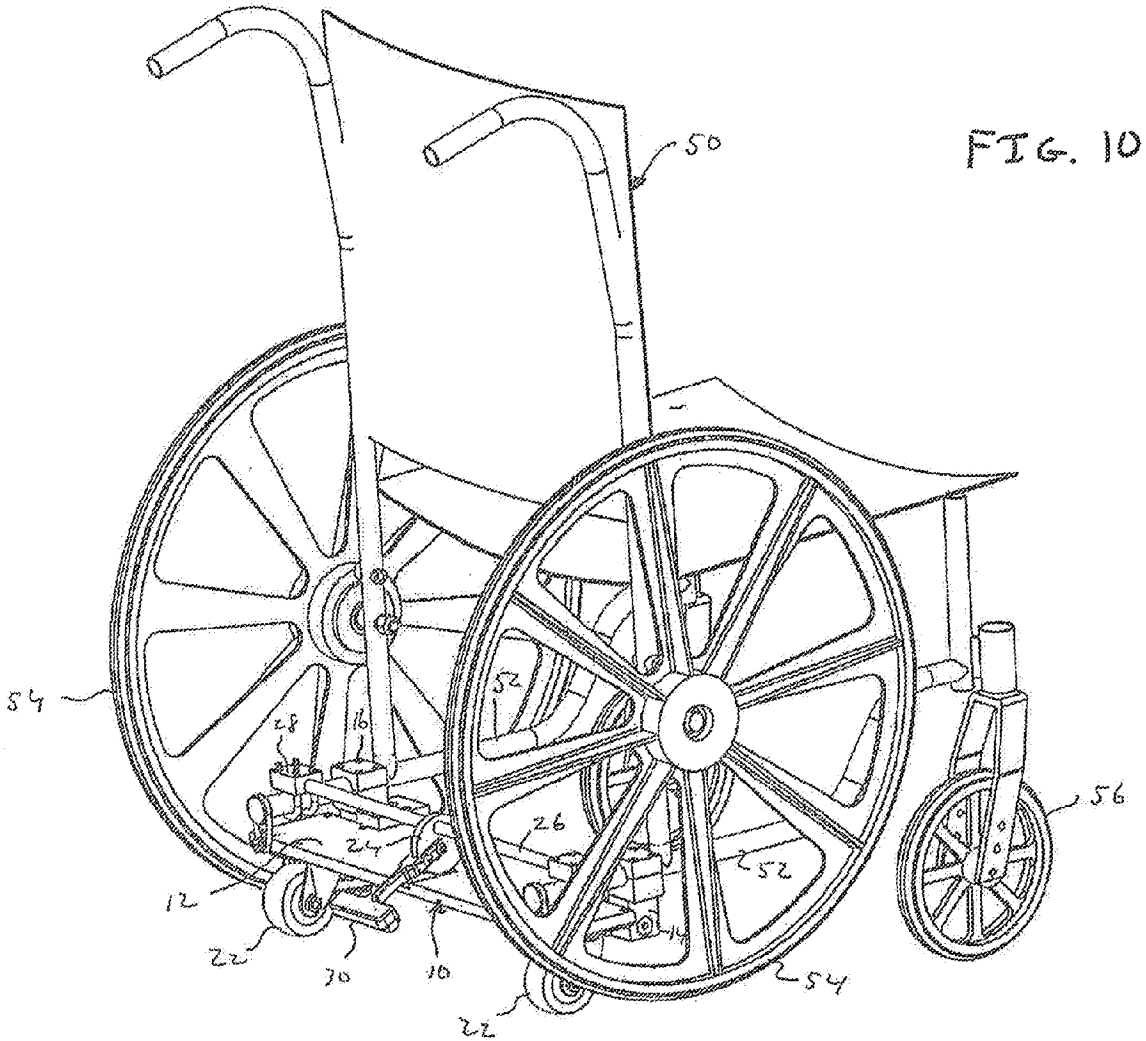
FIG. 10 is a rear isometric view of the exemplary wheeled lifting device in an extended configuration installed on the exemplary wheelchair.
Figure 10A:
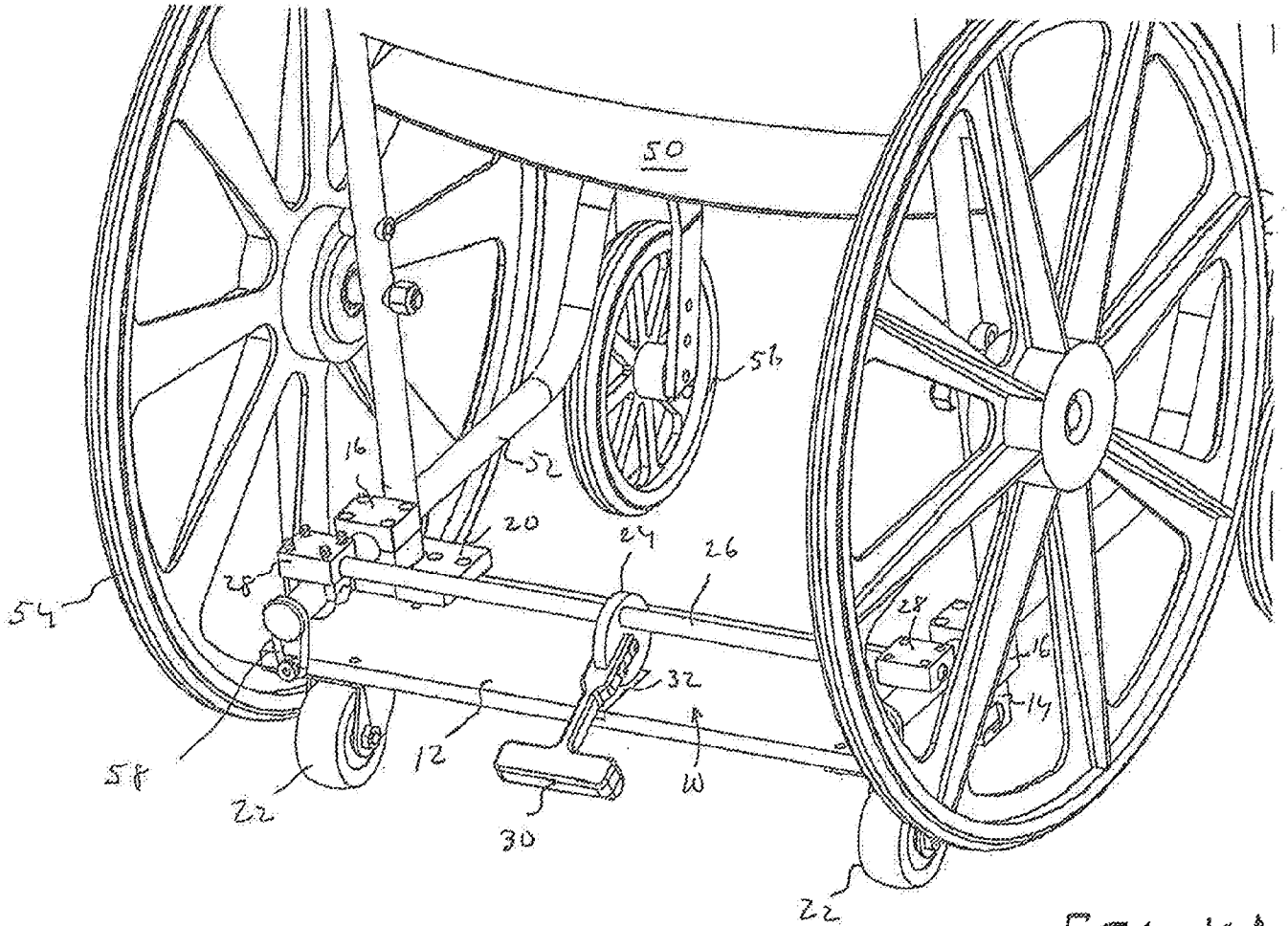
FIG. 10A is an expanded view of FIG. 10.
Figure 11:
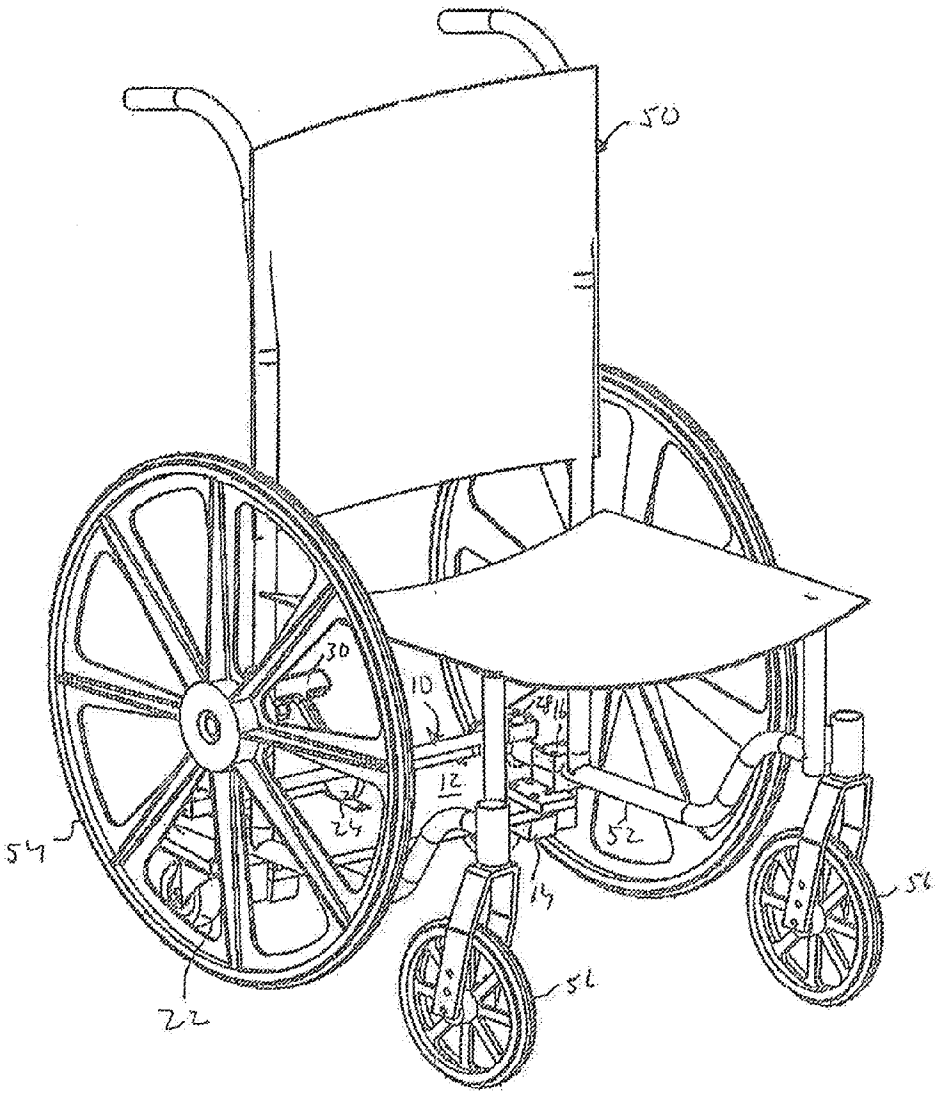
FIG. 11 is a front isometric view of the exemplary wheeled lifting device in a retracted configuration installed on the exemplary wheelchair.
Figure 12:
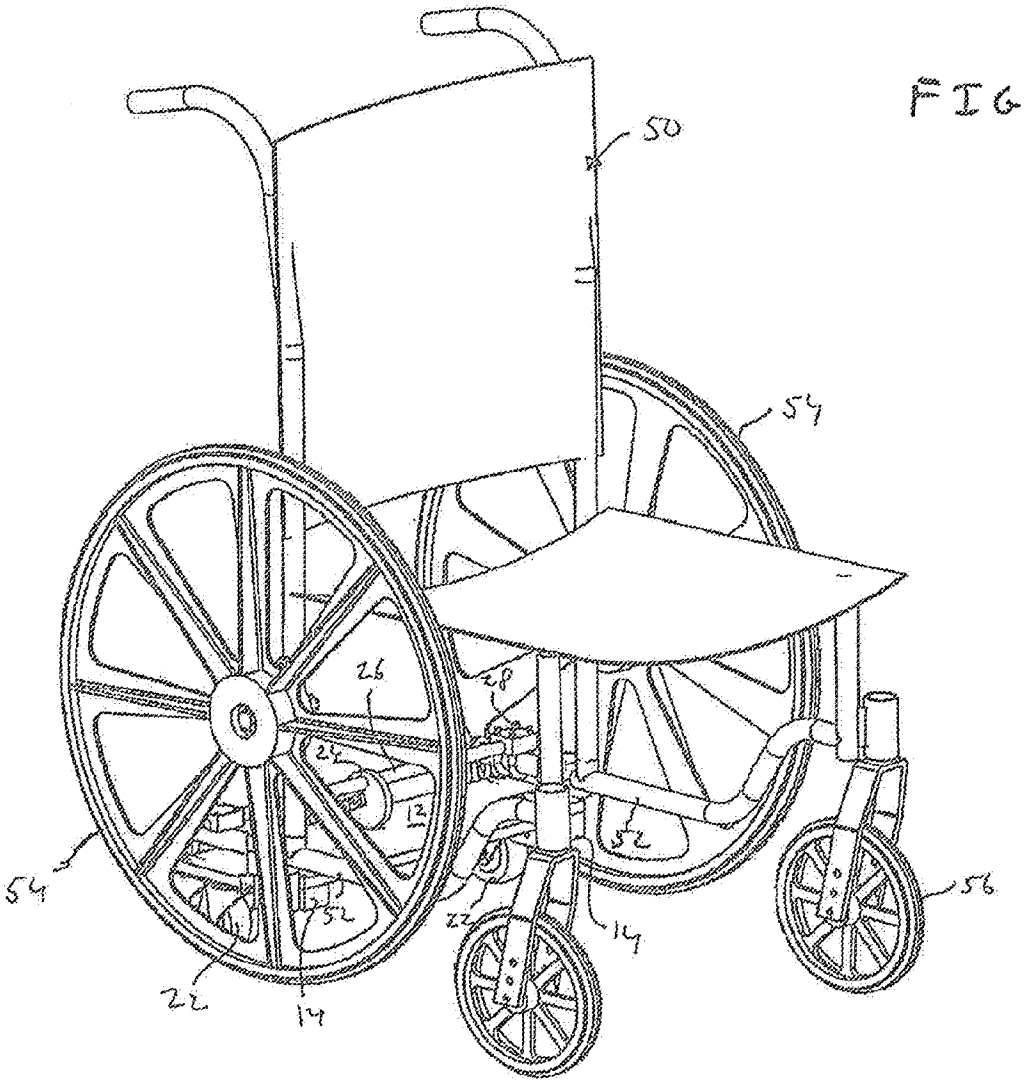
FIG. 12 is a front isometric view of the exemplary wheeled lifting device in an extended configuration installed on the exemplary wheelchair.
Figure 13:
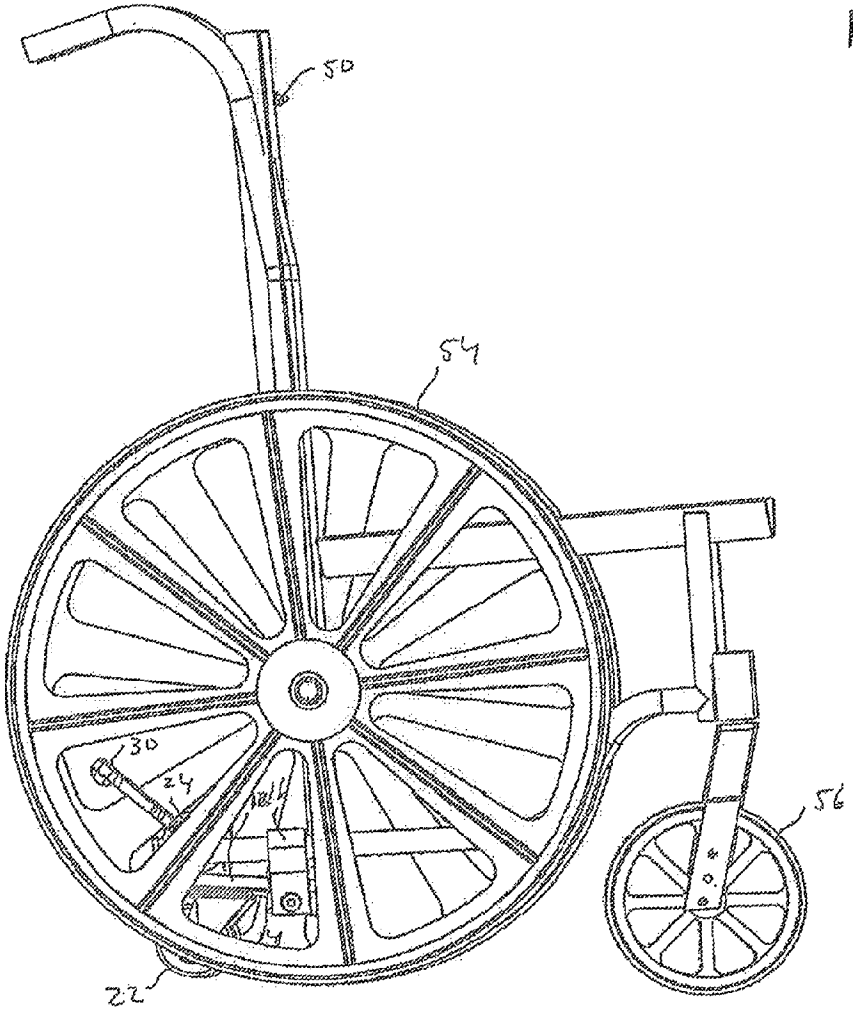
FIG. 13 is a side view of the exemplary wheeled lifting device in a retracted configuration installed on the exemplary wheelchair.
Figure 14:
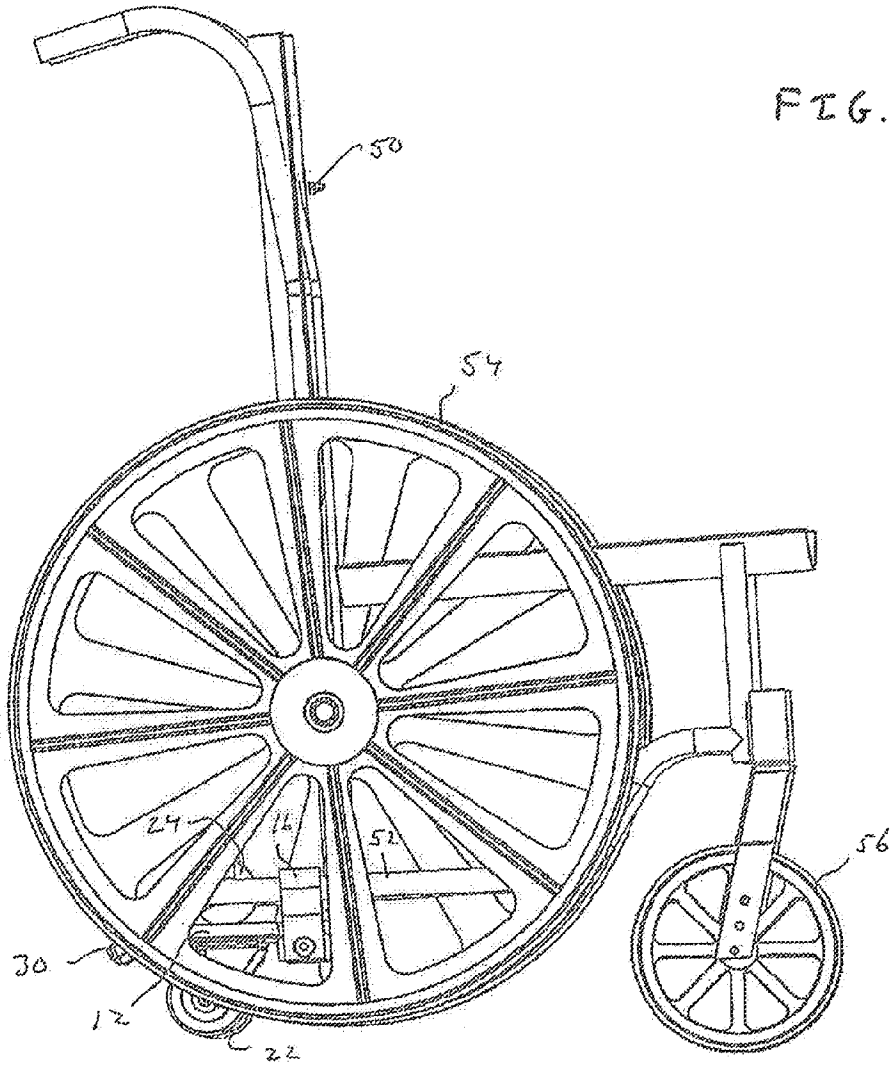
FIG. 14 is a side view of the exemplary wheeled lifting device in an extended configuration installed on the exemplary wheelchair.
Figure 15:
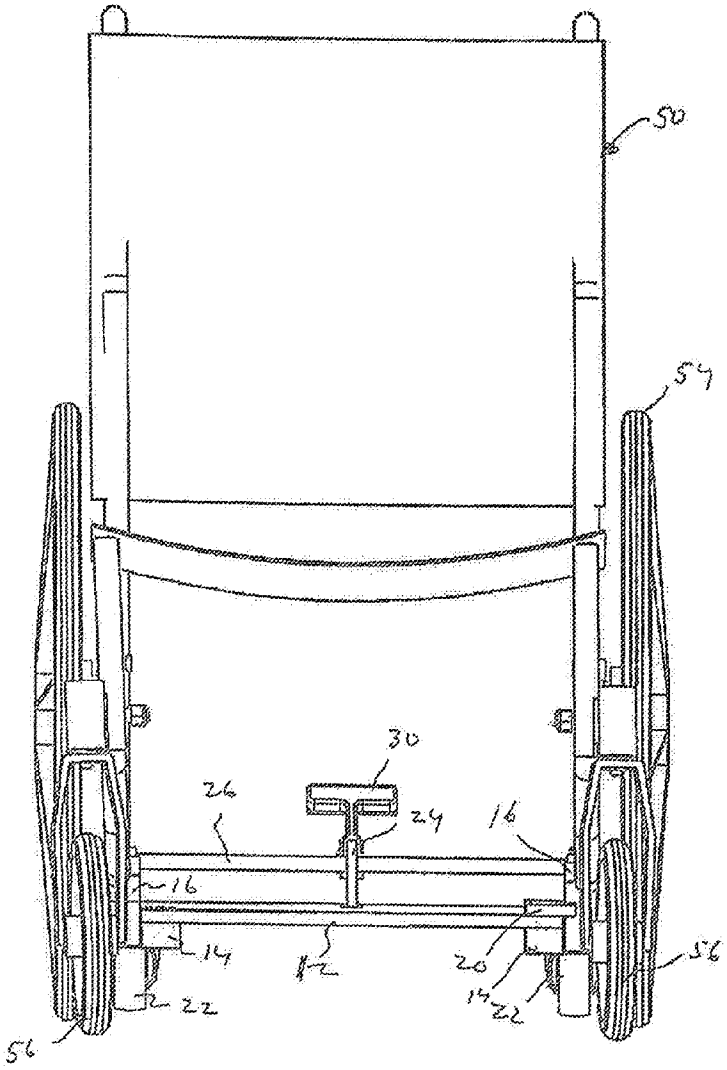
FIG. 15 is a front view of the exemplary wheeled lifting device in a retracted configuration installed on the exemplary wheelchair.
Figure 16:
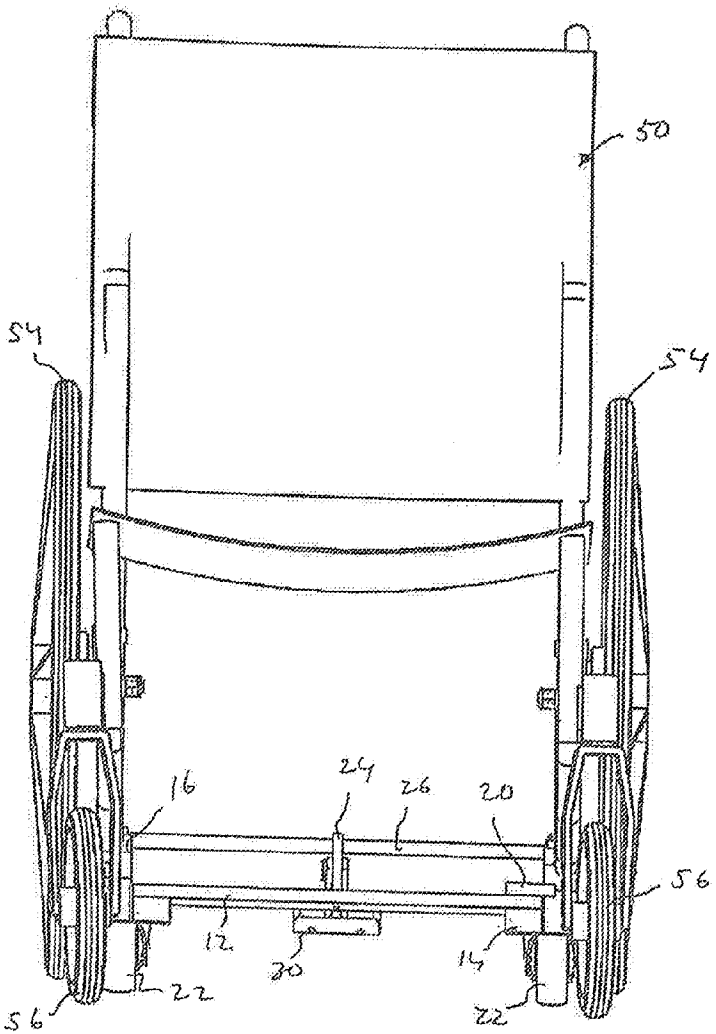
FIG. 16 is a front view of the exemplary wheeled lifting device in an extended configuration installed on the exemplary wheelchair.
Figure 17:
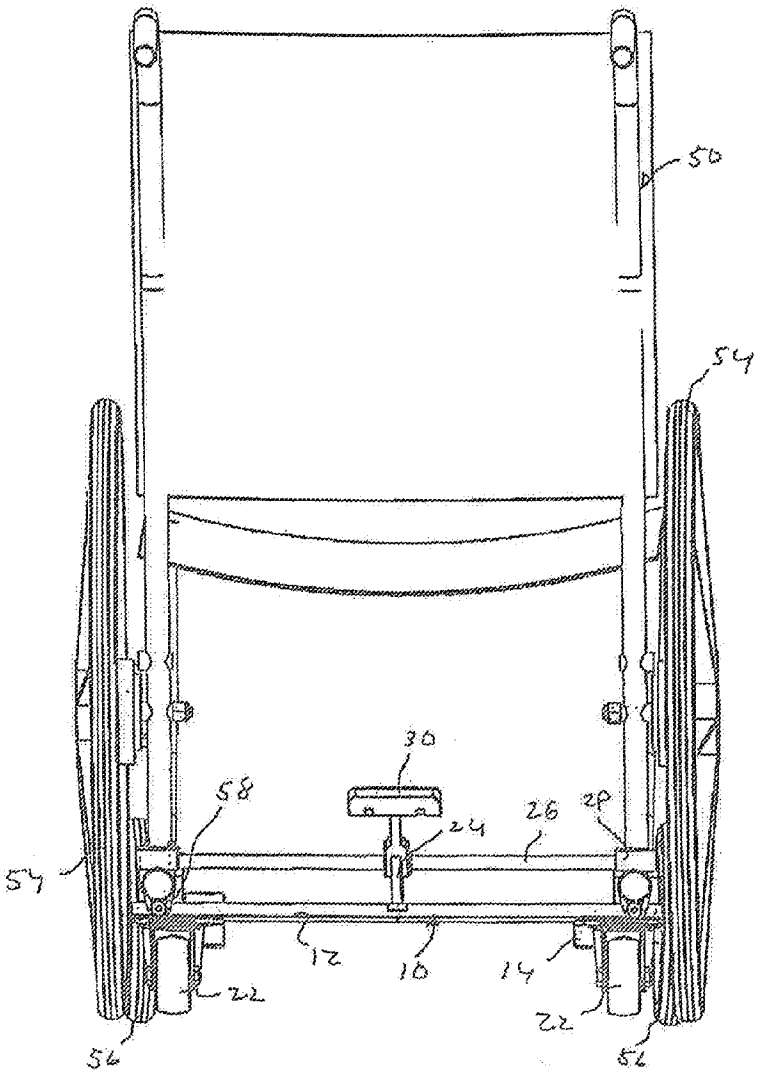
FIG. 17 is a rear view of the exemplary wheeled lifting device in a retracted configuration installed on the exemplary wheelchair.
Figure 18:
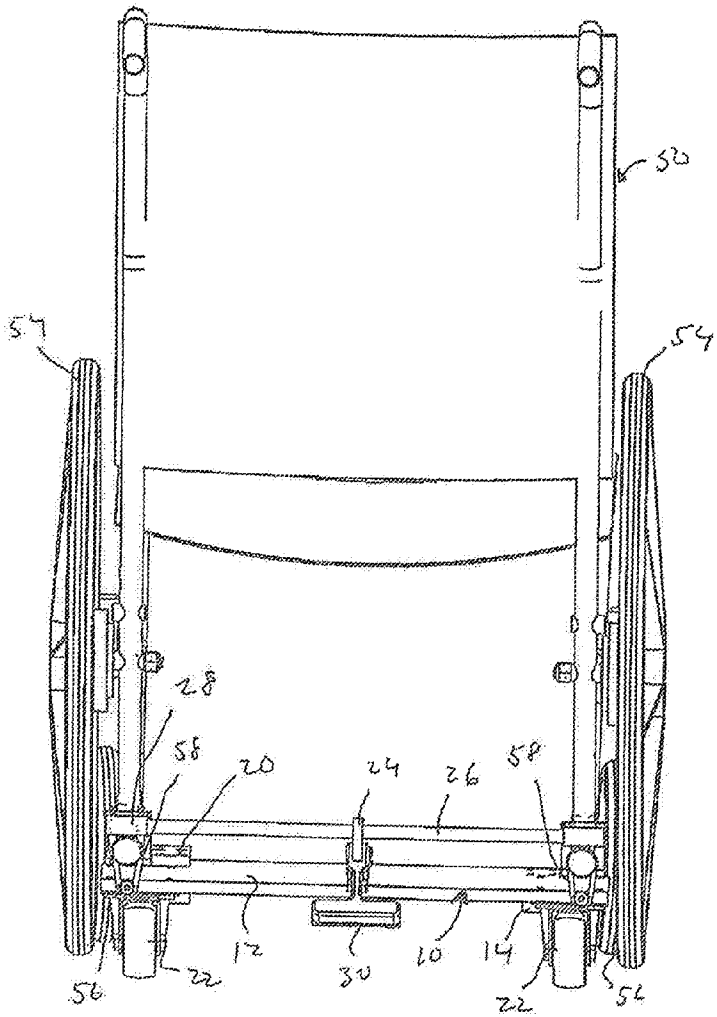
FIG. 18 is a rear view of the exemplary wheeled lifting device in an extended configuration installed on the exemplary wheelchair.
Figure 19A:
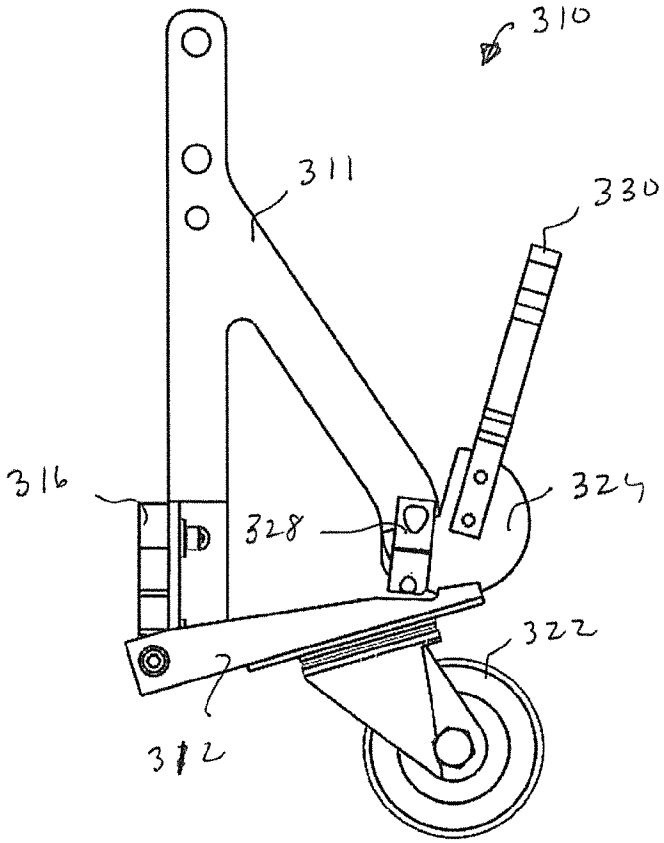
FIG. 19A is a side view of another exemplary wheeled lifting device in a retracted configuration according to the present invention.
Figure 19B:
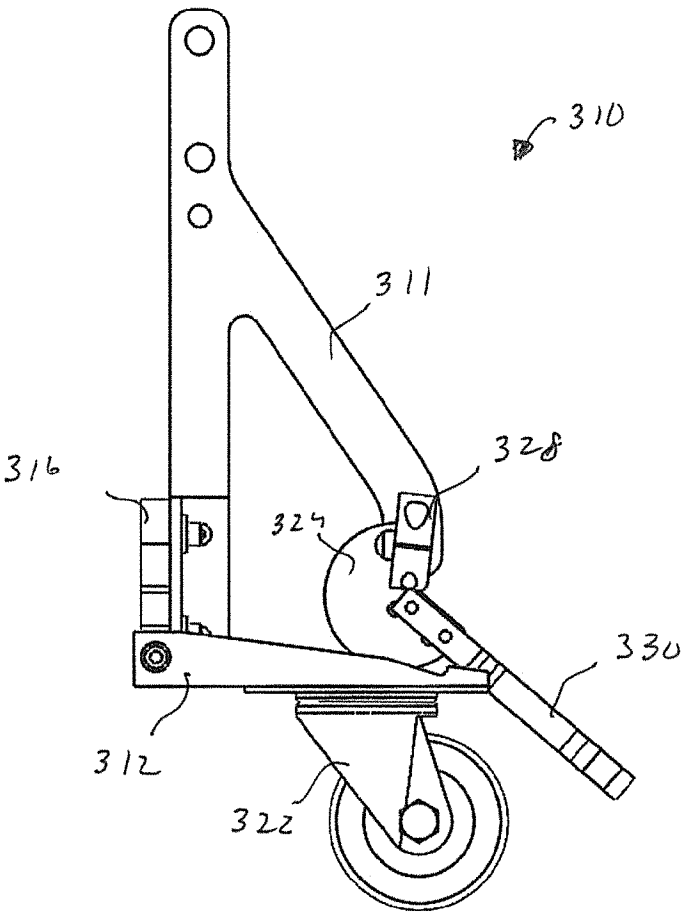
FIG. 19B is a side view of the other exemplary wheeled lifting device in an extended configuration according to the present invention.
Figure 20A:
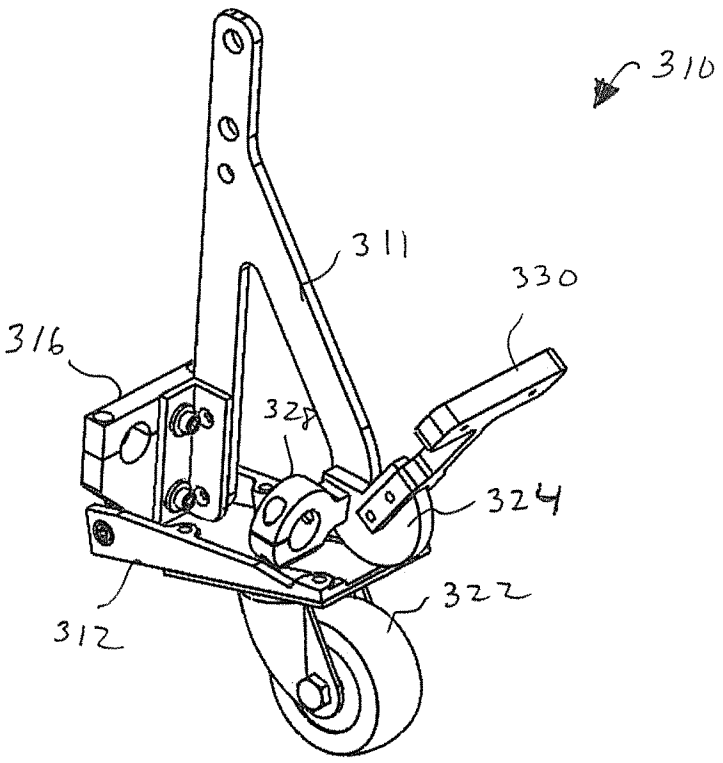
FIG. 20A is an isometric view of the other exemplary wheeled lifting device in a retracted configuration according to the present invention.
Figure 20B:
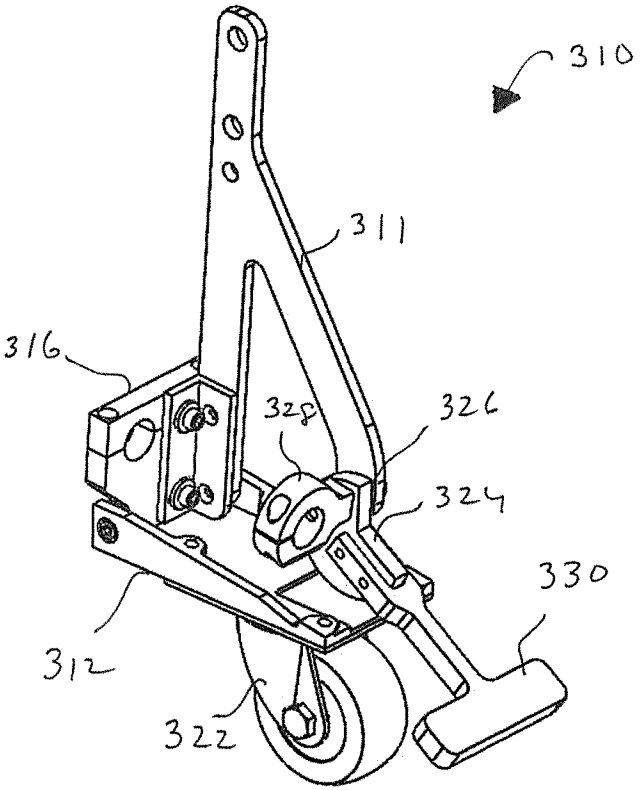
FIG. 20B is an isometric view of the other exemplary wheeled lifting device in an extended configuration according to the present invention.
Figure 21A:
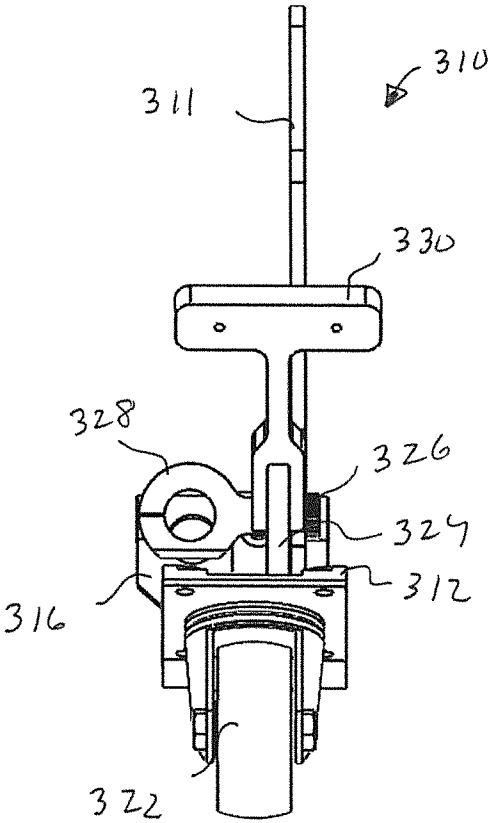
FIG. 21A is a rear view of the other exemplary wheeled lifting device in a retracted configuration according to the present invention.
Figure 21B:
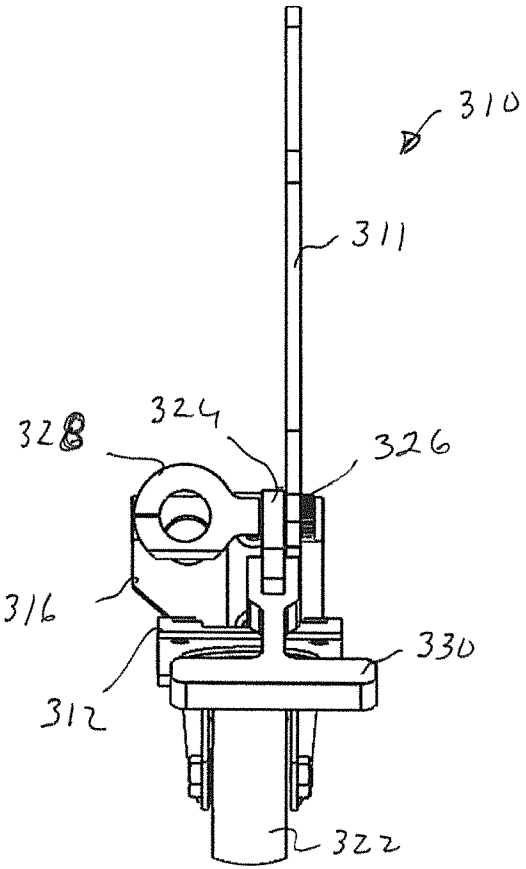
FIG. 21B is rear view of the other exemplary wheeled lifting device in an extended configuration according to the present invention.
Figure 22:
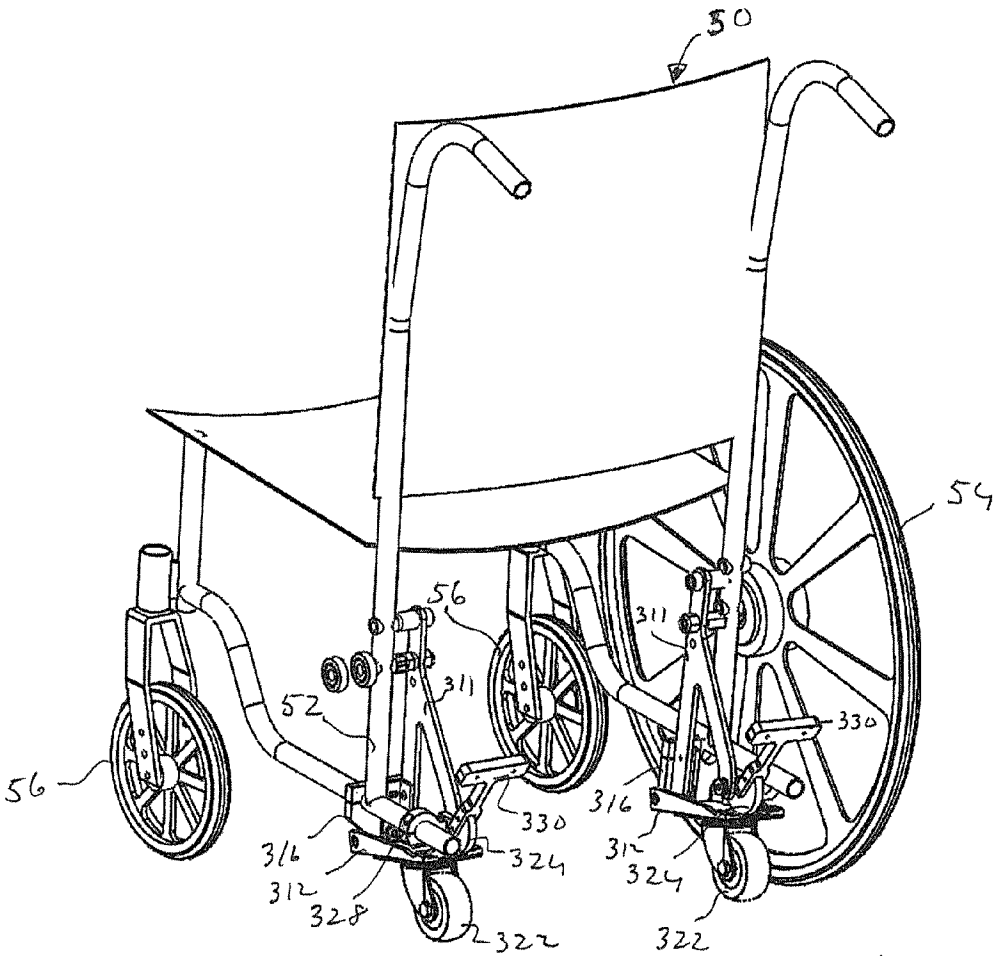
FIG. 22 is a rear isometric view of the other exemplary wheeled lifting device in a retracted configuration installed on an exemplary wheelchair.
Figure 23:
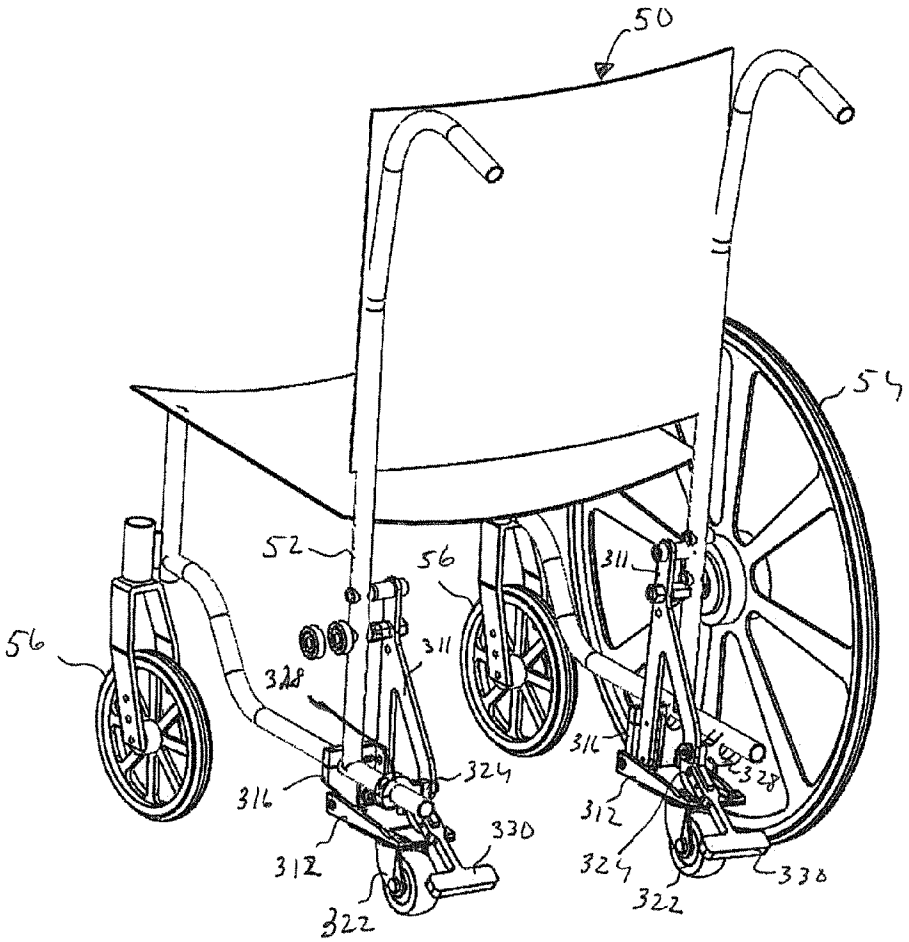
FIG. 23 is a rear isometric view of the other exemplary wheeled lifting device in an extended configuration installed on the exemplary wheelchair.
Figure 24:
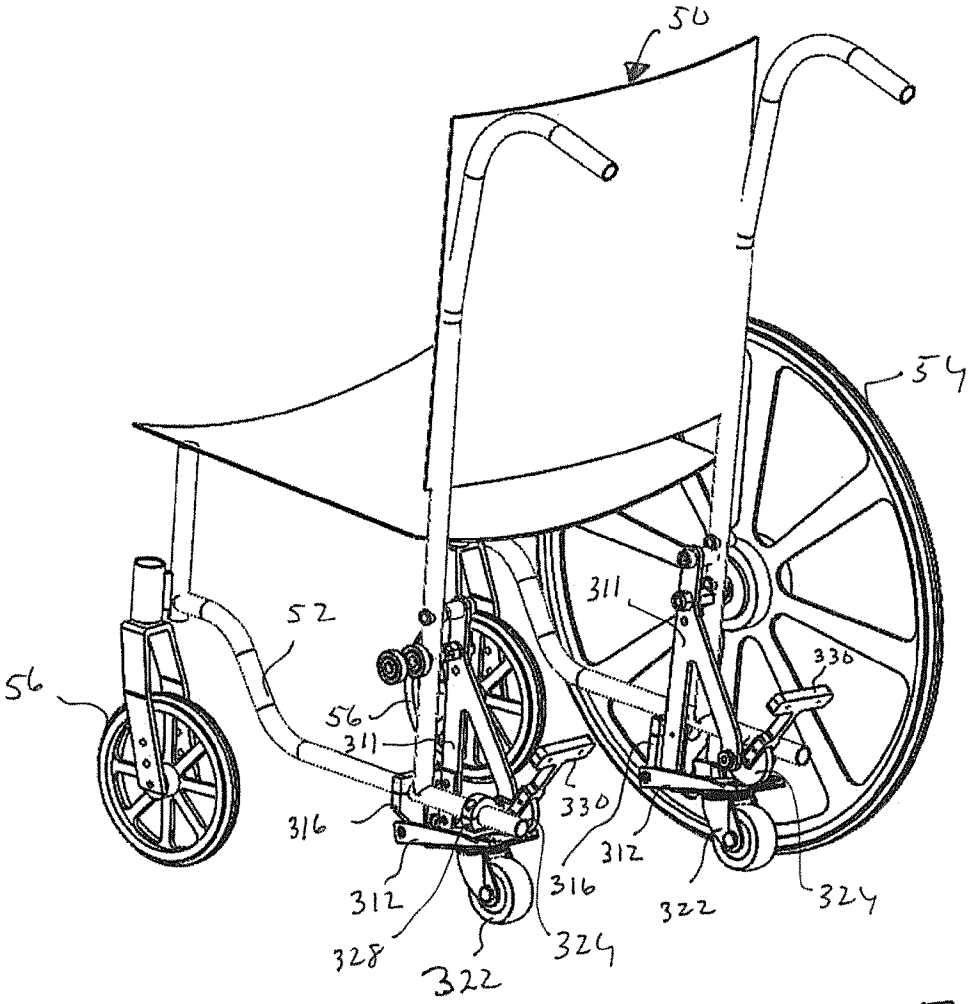
FIG. 24 is a side isometric view of the other exemplary wheeled lifting device in a retracted configuration installed on the exemplary wheelchair.
Figure 25:
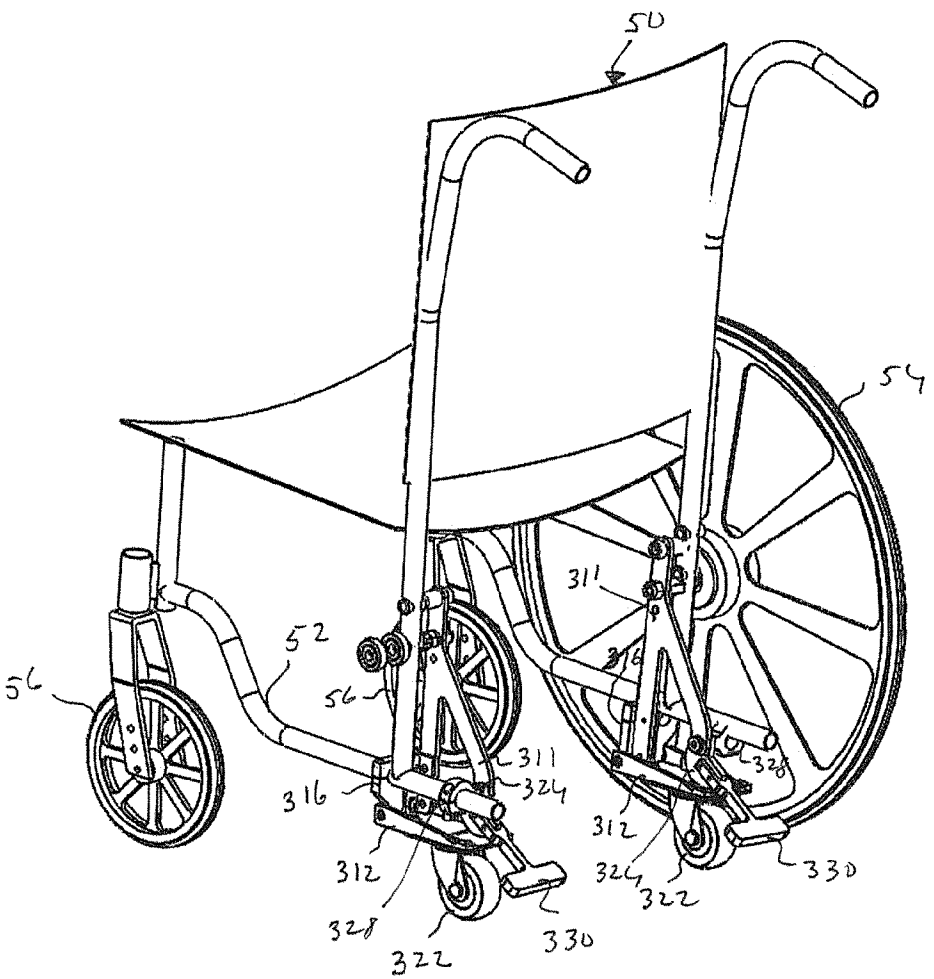
FIG. 25 is a side isometric view of the other exemplary wheeled lifting device in an extended configuration installed on the exemplary wheelchair.
Figure 26:
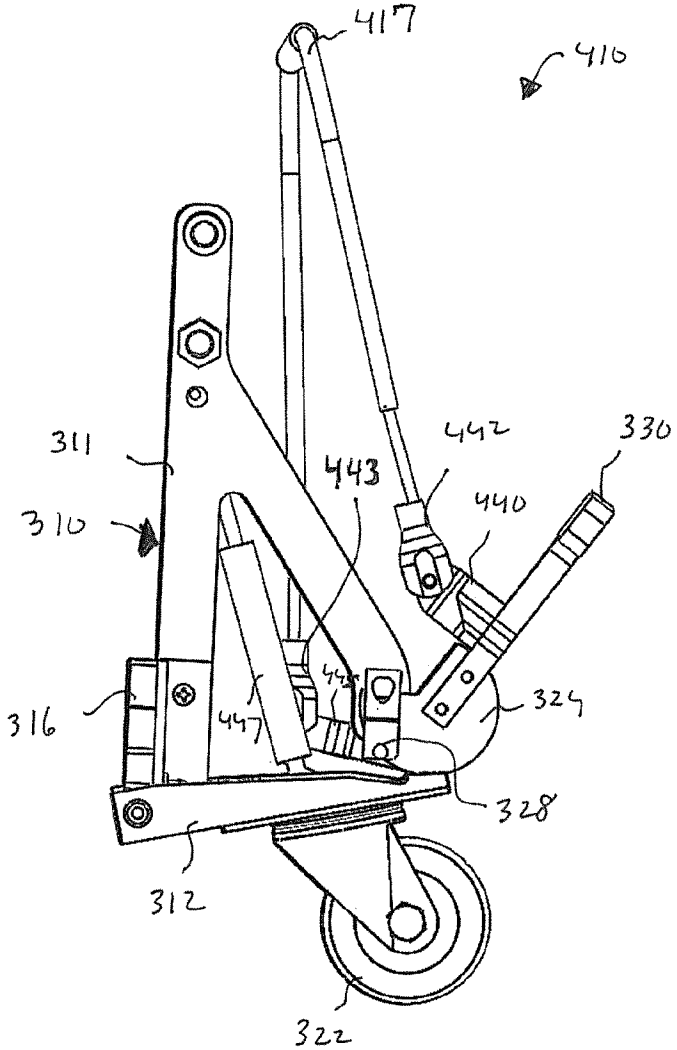
FIG. 26 is a side view of another exemplary wheeled lifting device in a retracted configuration according to the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIGS. 1-8, therein illustrated is an exemplary embodiment of a wheeled lifting device, generally indicated by reference numeral 10, according to the present invention. The wheeled lifting device 10 includes a platform 12 that is attached to a pair of blocks 14 that are each pivotably connected to a clamping mechanism 16. As discussed further below, the clamping mechanism 16 is configured to secure the wheeled lifting device 10 to the structure of another device, for example a wheelchair. The platform 12 may be attached to the pair of block 14 by any suitable fastening mechanism 18, for example screws or bolts. The wheeled lifting device 10 also includes a wedging block 20 attached to the platform 12 and positioned adjacent to one of the clamping mechanisms 16. The wheeled lifting device 10 may also include one or more multi-directional wheels 22 attached to the platform 12, for example the multi-directional wheels 22 may be caster wheels. The multi-directional wheels 22 may be secured to the platform 12 by any suitable fastening mechanism, such as screws, bolts, welds, epoxies, adhesives or a combination thereof, and may preferably be secured to the platform 12 so that the multi-directional wheels 22 may pivot about their bases that are secured to the platform 12. The wheeled lifting device 10 also includes an eccentric cam 24 that is eccentrically attached to a pivot bar 26 so that the eccentric cam 24 is configured for eccentric angular movement about the pivot bar 26. The eccentric cam 24 may have a substantially circular shape, or may have a shape that is not circular, such as an oblong or elliptical shape. Furthermore, the pivot bar 26 is preferably inserted through a point and/or area of the eccentric cam 24 that is not the center point and/or area of the eccentric cam 24. The pivot bar 26 is connected to a pair of supports 28 that are configured to secure the pivot bar 26 of the wheeled lifting device 10 to the structure of another device, for example a wheelchair. In this manner, the pivot bar 26 and eccentric cam 24 along with the platform 12 may be secured to the same device and positioned on the device to allow for interoperation between the eccentric cam 24 and the platform 12, as discussed further below. The wheeled lifting device 10 may also include a lever 30 attached to the eccentric cam 24 in order to facilitate angular movement of the eccentric cam 24 about the pivot bar 26. An insert plate 32 may be attached to the platform 12 at the position that contacts the eccentric cam 24 in order to facilitate movement of the eccentric cam 24 relative to the platform 12 and to provide a surface on which the eccentric cam 24 can act upon. The insert plate 32 also provides the advantage that if the insert plate 32 wears down, the insert plate 32 can be replaced without the need to replace the entire platform 12. In this manner, it may be preferable that the insert plate 32 is made from a material that is softer than the eccentric cam 24 so that the insert plate 32 wears more than the eccentric cam 24 does due to the operation of the eccentric cam 24 against the insert plate 32, as discussed further below. While the pivot bar 26 can eccentric cam 24 are shown as separate pieces of the wheeled lifting device 10 than the platform 12 and clamping mechanisms 16, it is understood that suitable connections may be made from each support 28 to the corresponding clamping mechanism 16 in order to have wheeled lifting device 10 have a unitary structure.

The installation, operation and use of the wheeled lifting device 10 will now be discussed with reference to FIGS. 9-18. The wheeled lifting device 10 may be installed on a device, such as a wheelchair 50 by attaching the clamping mechanisms 16 and supports 28 to the structure 52 of the wheelchair 50. Once attached to the wheelchair 50, the wheeled lifting device 10 may be positioned in a retracted configuration, as shown for example in FIGS. 9, 9A, 11, 13, 15 and 17, in which the multi-directional wheels 22 are positioned above or even with the rear wheels 54 of the wheelchair 50. In the retracted configuration, the multi-directional wheels 22 either do not contact a surface on which the rear wheels 54 of the wheelchair 50 are positioned or contact the surface in combination with the rear wheels 54. When in the retracted configuration, the wheeled lifting device 10 permits the wheelchair 50 to operate in the normal manner as understood by those skilled in the art. In order to move the wheeled lifting device 10 into an extended configuration, as shown for example in FIGS. 10, 10A, 12, 14, 16 and 18, the lever 30 is depressed in a direction towards the surface on which the wheelchair 50 is positioned in order to cause angular movement of the eccentric cam 24 about the pivot bar 26. The eccentric cam 24 may be configured for movement relative to the pivot bar 26 so that the eccentric cam 24 pivots about the point and/or area through which the pivot bar 26 passes through the eccentric cam 24, or in the alternative, the pivot bar 26 may be fixed to the eccentric cam 24 and the pivot bar 26 rotates relative to the supports 28. Since the eccentric cam 24 is eccentric with respect to the pivot bar 26, such angular movement of the eccentric cam 24 urges the platform 12 away from the pivot bar 26 as a result of the eccentric cam 24 bearing upon the insert plate 32 attached to the platform 12, and this bearing causes the platform 12 to pivot about the connections between the blocks 14 and the clamping mechanisms 16. The pivoting of the blocks 14 relative to the clamping mechanisms 16 causes the platform 12 to move angularly with respect to the clamping mechanisms 16, which have been secured to the structure 52 of the wheelchair 50. Since the clamping mechanisms 16 are secured to the structure 52 of the wheelchair 50, and the platform 12 is movable relative to the wheelchair 50, the angular movement of the platform 12 causes the multi-directional wheels 22 to move into the extended configuration in which the multi-directional wheels 22 extend out past the wheels 54 of the wheelchair 50, and lift the wheels 54 of the wheelchair 50 off of the surface on which the wheels 54 have been in contact with so that only the multi-directional wheels 22 are in contact with the surface. In this manner, the movement of the wheelchair 50 may now be controlled with respect to the multi-directional wheels 22 and the front wheels 56 of the wheelchair 50, which allows for multi-directional movement and tight turning of the wheelchair 50. The wheeled lifting device 10 may be secured in the extended position by action of the wedging block 20 against one of the clamping mechanisms 16, and one or more elastic bands 58 that have been secured to the platform 12 and the structure 52 of the wheelchair 50. The elastic bands 58 act to pull the platform 12 in a direction towards the eccentric cam 24 so that rotation of the eccentric cam 24 about the pivot bar 26 is restricted in order to lock the wheeled lifting device 10 into the extended configuration. In order to return the wheeled lifting device 10 the retracted configuration, the lever 30 may be lifted in a direction away from the surface on which the multi-directional wheels 22 are positioned in order to move the eccentric cam 24 angularly to allow the platform 12 to also move angularly relative to the clamping mechanisms 16 in order to withdraw the multi-directional wheels 22 either even with or above the rear wheels 54 of the wheelchair 50.

The wheeled lifting device 10 may be made from any suitable material, for example, a metal, such as steel, aluminum or stainless steel, or from a durable plastic. Furthermore, while it may be preferable that the wheeled lifting device 10 can be manually operated through the use of a mechanical mechanism, it is understood that the present invention is not limited to such mode of operation, and it is contemplated that the wheeled lifting device 10 may be electronically and/or hydraulically operated and even configured for remote operation.

Referring now to FIGS. 35-39, therein illustrated is another exemplary embodiment of the wheeled lifting device, generally indicated by reference numeral 110, according to the present invention. The wheeled lifting device 110 according to this exemplary embodiment of the present invention may be operated and/or actuated by hydraulic mechanisms, as discussed further below. The wheeled lifting device 110 includes a pair of brackets 111 that are each connected to a clamping device 113 that is configured to attach the pair of brackets 111 to appropriate locations on a structure 52 of a wheelchair 50, as shown for example in FIGS. 40-45.

Referring again to FIGS. 35-39, the wheeled lifting device 110 may also include a hydraulic piston 115 operatively coupled to each bracket 111 and a multi-directional wheel 122, for example a caster wheel. The multi-directional wheel 122 may be operatively secured to the hydraulic piston 115 such that the multi-directional wheel 122 may pivot 360° about the longitudinal axis of the hydraulic piston 115. The hydraulic piston 115 may also be connected to a hydraulic line 123 that is connected to a hydraulic actuator mechanism 125, and it is understood that while a hydraulic line 123 and hydraulic actuator mechanism 125 is shown for each hydraulic piston 115, it is contemplated that a single hydraulic line 123 and/or hydraulic actuator mechanism 125 may be used for the present invention. Furthermore, it is understood that the hydraulic line 123 may be any suitable length, or it may be possible that the hydraulic actuator mechanism 125 is positioned directly relative to the hydraulic piston 115 so that no hydraulic lines are needed. The hydraulic actuator mechanism 125 may be connected to the structure 52 of the exemplary wheelchair 50 through the use of one or more clamps 127, as shown for example in FIGS. 40-45. The clamps 127 may be configured so as to position the hydraulic actuator mechanisms 125 near to and/or close to the handles of the wheelchair 50 so that an operator does not have to reach to operate the hydraulic actuator mechanisms 125.

The installation, operation and use of the wheeled lifting device 110 will now be discussed with reference to FIGS. 40-45. The wheeled lifting device 110 may be installed on a device, such as a wheelchair 50 by attaching the clamping devices 113 and clamps 127 to the structure 52 of the wheelchair 50. Once attached to the wheelchair 50, the wheeled lifting device 110 may be positioned in a retracted configuration, as shown for example in FIGS. 41, 43 and 45, in which the multi-directional wheels 122 are positioned above or even with the rear wheels 54 of the wheelchair 50. In the retracted configuration of the wheeled lifting device 110, the multi-directional wheels 122 are either above the surface on which the rear wheels 54 of the wheelchair 50 are positioned or on the surface in combination with the rear wheels 54 of the wheelchair 50. When in the retracted configuration, the wheeled lifting device 110 permits the wheelchair 50 to operate in the normal manner as understood by those skilled in the art. In order to move the wheeled lifting device 110 into an extended configuration, as shown for example in FIGS. 40, 42 and 44, the hydraulic actuator mechanisms 125 are operated in order to extend hydraulic pistons 115 away from the brackets 111 as understood to one of ordinary skill in the art familiar with hydraulic operation. Since the clamping devices 113 are secured to the wheelchair 50, and the multi-directional wheels 122 are movable relative to the wheelchair 50, the extension of the pistons 115 causes the multi-directional wheels 122 to move into an extended position in which the multi-directional wheels 122 extend out past the wheels 54 of the wheelchair 50, and lift the wheels 54 of the wheelchair 50 off of the ground. In this manner, the movement of the wheelchair 50 may now be controlled with respect to the multi-directional wheels 122 and the front wheels 56 of the wheelchair 50, which allows for multi-directional movement and tight turning of the wheelchair 50, because the front wheels 56 and the multi-directional wheels 122 are configured to rotate about the axis on which they are connected to the wheelchair 50. The wheeled lifting device 110 may be secured in the extended position by through the hydraulic pressure applied to the hydraulic pistons 115. In order to return the wheeled lifting device 110 the retracted configuration, the hydraulic pressure is released through actuation of the hydraulic actuator mechanisms 125 so that the hydraulic pistons 115 collapse in order to withdraw the multi-directional wheels 122 either even with or above the rear wheels 54 of the wheelchair 50.

Referring now to FIGS. 46-51, therein illustrated is another exemplary embodiment of the wheeled lifting device, generally indicated by reference numeral 210, according to the present invention. The wheeled lifting device 210 according to this exemplary embodiment of the present invention may be operated and/or actuated by pneumatic (air) mechanisms, as discussed further below. The wheeled lifting device 210 includes a pair of brackets 211 that are each connected to a clamping device 213 that is configured to attach the pair of brackets 211 to appropriate locations on a structure 52 of a wheelchair 50, as shown for example in FIGS. 52-57.

Referring again to FIGS. 46-51, the wheeled lifting device 210 may also include a pneumatic piston 215 operatively coupled to each bracket 211 and a multi-directional wheel 222, for example a caster wheel. The multi-directional wheel 222 may be operatively secured to the pneumatic piston 215 such that the multi-directional wheel 222 may pivot 360° relative to the axis of the pneumatic piston 215. Each of the pneumatic pistons 215 may also be connected to an air line 231 that is connected to a regulator 233, and it is understood that while an air line 231 is shown for each pneumatic piston 215, it is contemplated that an air line 231 may be used for both pneumatic pistons 215 for the present invention. The regulator 233 is configured to attachment to a compressed air source 235, and may include an actuation mechanism 237 that is configured to either provide air to the pneumatic pistons 215 or release air from the pneumatic pistons 215 in order to operate the pneumatic pistons 215. The regulator 233 may also include a gauge 239 to show the pressure of the air in the compressed air source 235.

The installation, operation and use of the wheeled lifting device 210 will now be discussed with reference to FIGS. 52-53, 53A and 54-57. The wheeled lifting device 210 may be installed on a device, such as a wheelchair 50 by attaching the clamping devices 213 at appropriate locations to the structure 52 of the wheelchair 50. Once attached to the wheelchair 50, the wheeled lifting device 210 may be positioned in a retracted configuration, as shown for example in FIGS. 53-54 and 56-57, in which the multi-directional wheels 222 are positioned above or even with the rear wheels 54 of the wheelchair 50. In the retracted configuration, the multi-directional wheels 222 are positioned so that the multi-directional wheels 222 do not contact the surface on which the rear wheels 54 of the wheelchair 50 are positioned or contact the surface in combination with the rear wheels 54. When in the retracted configuration, the wheeled lifting device 210 permits the wheelchair 50 to operate in the normal manner as understood by those skilled in the art. In order to move the wheeled lifting device 210 into an extended configuration, as shown for example in FIGS. 52, 53A and 55, the actuation mechanism 237 is operated in order to extend the pneumatic pistons 215 away from the brackets 211 as understood to one of ordinary skill in the art familiar with pneumatic operation. Since the clamping devices 213 are secured to the wheelchair 50, and the multi-directional wheels 222 are movable relative to the wheelchair 50, the extension of the pistons 215 causes the multi-directional wheels 222 to extend out past the wheels 54 of the wheelchair 50 and lift the wheels 54 of the wheelchair 50 off of the ground. In this manner, the movement of the wheelchair 50 may now be controlled with respect to the multi-directional wheels 222 and the front wheels 56 of the wheelchair 50, which allows for multi-directional movement and tight turning of the wheelchair 50. The wheeled lifting device 210 may be secured in the extended position by through the pneumatic pressure applied to the pneumatic pistons 215. In order to return the wheeled lifting device 210 the retracted configuration, the pneumatic pressure is released through actuation of the actuation mechanism 237 so that the pneumatic pistons 215 collapse in order to withdraw the multi-directional wheels 222 either even with or above the rear wheels 54 of the wheelchair 50, so that the rear wheels 54 of the wheelchair 50 are in contact with the surface on which the wheelchair 50 is positioned.

Referring now to FIGS. 19A, 19B, 20A, 20B, 21A and 21B, therein illustrated is another exemplary embodiment of the wheeled lifting device, generally indicated by reference numeral 310, according to the present invention. The wheeled lifting device 310 includes a platform 312 that is pivotably connected to a clamping mechanism 316. As discussed further below, the clamping mechanism 316 is configured to secure the wheeled lifting device 310 to the structure 52 of another device, for example a wheelchair 50. The clamping mechanism 316 may be secured to a bracket 311 that may also be configured to secure the wheeled lifting device 310 to the structure 52 of the wheelchair 50. The wheeled lifting device 310 may also include one or more multi-directional wheels 322 attached to the platform 312, for example the multi-directional wheels 322 may be caster wheels. The multi-directional wheels 322 may be secured to the platform 312 by any suitable fastening mechanism, such as screws, bolts, welds, epoxies, adhesives or a combination thereof, and may preferably be secured to the platform 312 so that the multi-directional wheels 322 may pivot about their bases that are secured to the platform 312. The wheeled lifting device 310 also includes an eccentric cam 324 that is eccentrically attached to a pivot bar 326 that connects the bracket 311 to a support 328 that is configured to secure the wheeled lifting device 310 to the structure 52 of the wheelchair 50. The pivot bar 326 may be in the form of a bolt that passes through the bracket 311 and secures into the support 328. The eccentric cam 324 is coupled to the pivot bar 326 so that the eccentric cam 324 is configured for eccentric angular movement about the pivot bar 326. The eccentric cam 324 may have a substantially circular shape, or may have a shape that is not circular, such as an oblong or elliptical shape. Alternatively, the eccentric cam 324 may be a portion of the substantially circular shape, as shown in the present figures. Furthermore, the pivot bar 326 is preferably inserted through a point and/or area of the eccentric cam 324 that is not the center point and/or area of the eccentric cam 324. In this manner, the pivot bar 326 and eccentric cam 324 along with the platform 312 may be secured to the same device and positioned on the device, for example the wheelchair 50, to allow for interoperation between the eccentric cam 324 and the platform 312, as discussed further below.

Still referring to FIGS. 19B, 20A, 20B, 21A and 21B, the wheeled lifting device 310 may also include a lever 330 attached to the eccentric cam 324 in order to facilitate angular movement of the eccentric cam 324 about the pivot bar 326. An insert plate (not shown) may be attached to the platform 312 at the position that contacts the eccentric cam 324 in order to facilitate movement of the eccentric cam 324 relative to the platform 312 and to provide a surface on which the eccentric cam 324 can act upon. The insert plate also provides the advantage that if the insert plate wears down, the insert plate can be replaced without the need to replace the entire platform 312. In this manner, it may be preferable that the insert plate is made from a material that is softer than the eccentric cam 324 so that the insert plate wears more readily than the eccentric cam 324 does due to the operation of the eccentric cam 324 against the insert plate.

The installation, operation and use of the wheeled lifting device 310 will now be discussed with reference to FIGS. 22-25 and 33-34. The wheeled lifting device 310 may be installed on a device, such as a wheelchair 50 by attaching the clamping mechanisms 316 and supports 328 to the structure 52 of the wheelchair 50. The wheeled lifting device 310 may also be secured to the structure 52 of the wheelchair 50 by using suitable fasteners to also attach the bracket 311 to the structure 52 of the wheelchair 50. As shown in FIGS. 22-25 and 33-34, multiple wheeled lifting devices 310 may be installed on the wheelchair, one for each rear wheel 54 of the wheelchair 50. It is understood that one of the rear wheels 54 of the wheelchair 50 is not illustrated in FIGS. 22-25 and 33-34 in order to allow a better view of the wheeled lifting devices 310 installed on the wheelchair 50. Once attached to the wheelchair 50, the wheeled lifting device 310 may be positioned in a retracted configuration, as shown for example in FIGS. 22, 24 and 33, in which the multi-directional wheels 322 are positioned above or even with the rear wheels 54 of the wheelchair 50. In the retracted configuration, the multi-directional wheels 322 either do not contact a surface on which the rear wheels 54 of the wheelchair 50 are positioned or contact the surface in combination with the rear wheels 54. When in the retracted configuration, the wheeled lifting device 310 permits the wheelchair 50 to operate in the normal manner as understood by those skilled in the art. In order to move the wheeled lifting device 310 into an extended configuration, as shown for example in FIGS. 23, 25 and 34, the lever 330 of each wheeled lifting device 310 is depressed in a direction towards the surface on which the wheelchair 50 is positioned in order to cause angular movement of the eccentric cam 324 about the pivot bar 326 of each wheeled lifting device 310. The eccentric cam 324 may be configured for movement relative to the pivot bar 326 so that the eccentric cam 324 pivots about the point and/or area through which the pivot bar 326 passes through the eccentric cam 324, or in the alternative, the pivot bar 326 may be fixed to the eccentric cam 324 and the pivot bar 326 rotates relative to the supports 328. Since the eccentric cam 324 is eccentric with respect to the pivot bar 326, such angular movement of the eccentric cam 324 urges the platform 312 away from the pivot bar 326 as a result of the eccentric cam 324 bearing upon the platform 312, and this bearing causes the platform 312 to pivot about the connection to the clamping mechanism 316. Since the clamping mechanism 316 of each of the wheeled lifting devices 310 are secured to the structure 52 of the wheelchair 50, and the platform 312 of each wheeled lifting devices 310 is movable relative to the wheelchair 50, the angular movement of the platform 312 causes the multi-directional wheels 322 to move into the extended configuration in which the multi-directional wheels 322 extend out past the rear wheels 54 of the wheelchair 50, and lift the rear wheels 54 of the wheelchair 50 off of the surface on which the rear wheels 54 have been in contact with so that only the multi-directional wheels 322 are in contact with the surface. In this manner, the movement of the wheelchair 50 may now be controlled with respect to the multi-directional wheels 322 and the front wheels 56 of the wheelchair 50, which allows for multi-directional movement and tight turning of the wheelchair 50. The wheeled lifting device 310 may be secured in the extended position by the friction of the eccentric cam 324 against the platform 312 and having been wedged into such extended position through the action upon the lever 330. In order to return the wheeled lifting device 310 the retracted configuration, the lever 330 may be lifted in a direction away from the surface on which the multi-directional wheels 322 are positioned in order to move the eccentric cam 324 angularly to allow the platform 312 to also move angularly relative to the clamping mechanisms 316 in order to withdraw the multi-directional wheels 322 either even with or above the rear wheels 54 of the wheelchair 50.

Figure 27:
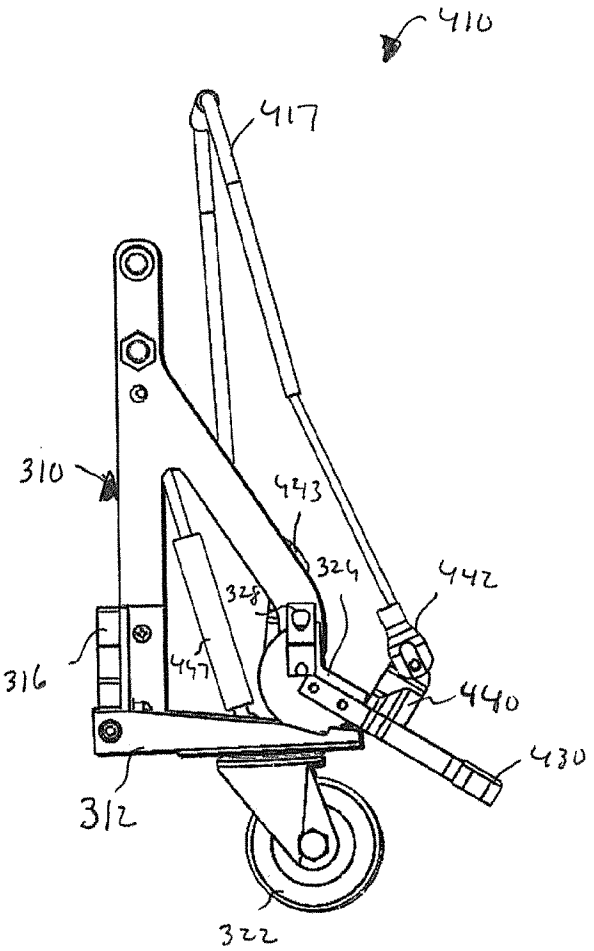
FIG. 27 is a side view of the other exemplary wheeled lifting device in an extended configuration according to the present invention.
Figure 28:
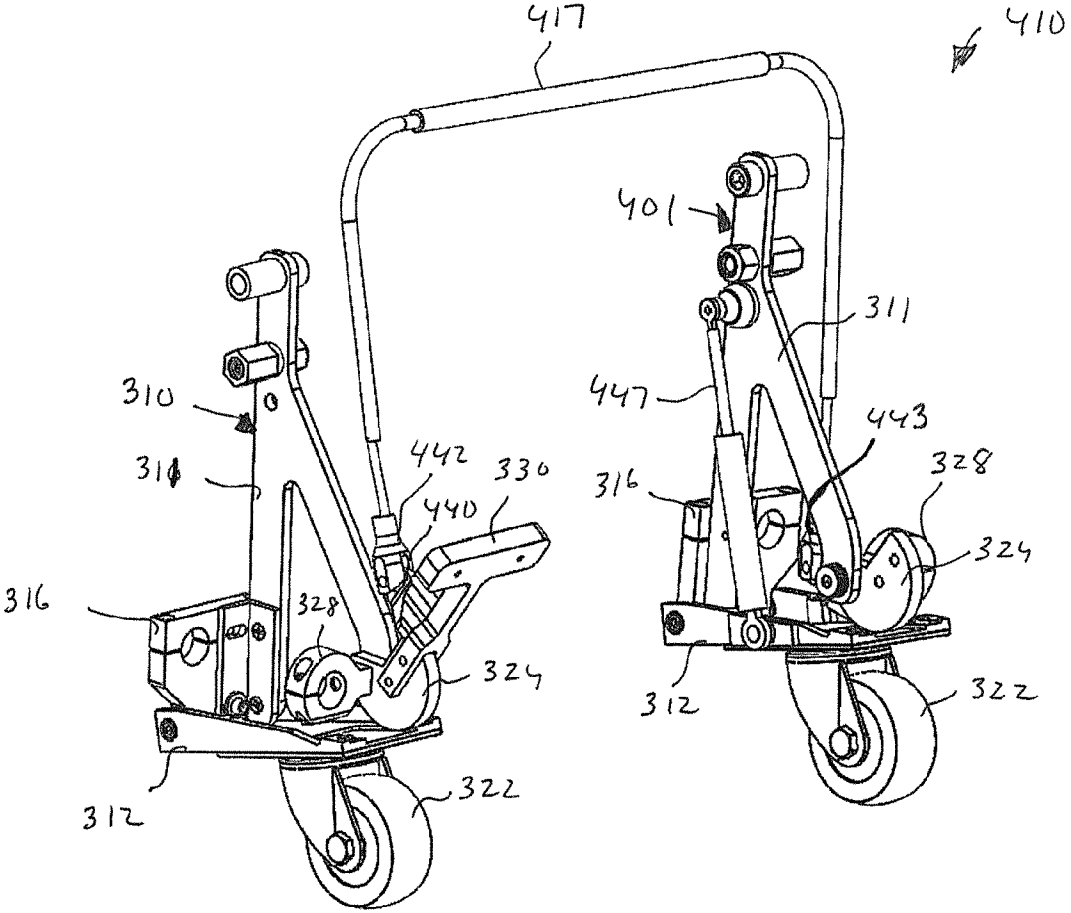
FIG. 28 is an isometric view of the other exemplary wheeled lifting device in a retracted configuration according to the present invention.
Figure 29:
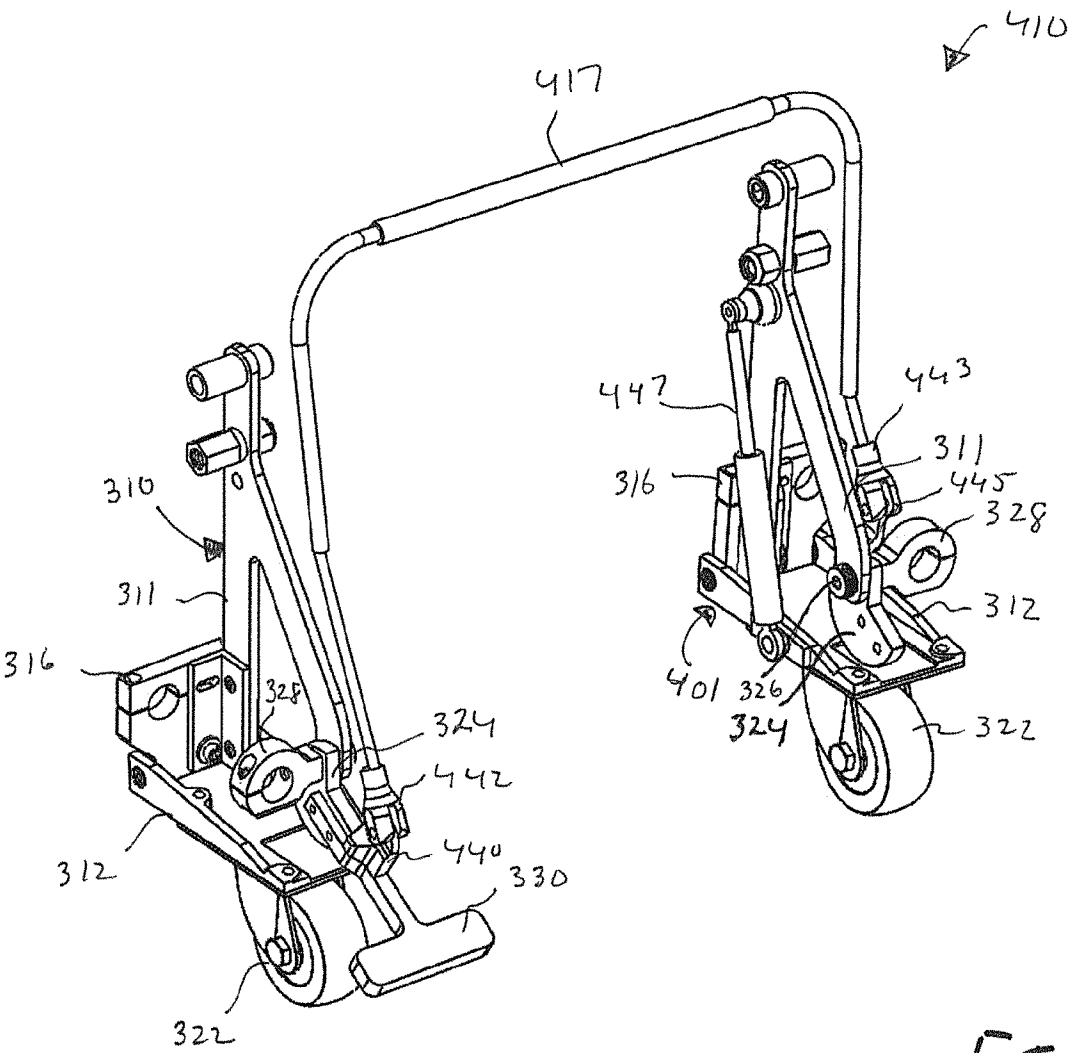
FIG. 29 is an isometric view of the other exemplary wheeled lifting device in an extended configuration according to the present invention.

Referring now to FIGS. 27-29, therein illustrated is another exemplary embodiment of the wheeled lifting device, generally indicated by reference numeral 410, according to the present invention. The wheeled lifting device 410 according to this exemplary embodiment generally includes a wheeled lifting device 310 according to the exemplary embodiment discussed above with respect to FIGS. 19B, 20A, 20B, 21A and 21B connected to a second modified wheeled lifting device 401 by a cable 417. The components of the wheeled lifting device 310 and modified wheeled lifting device 401 that make up the wheeled lifting device 410 are identified by the same reference numerals as discussed above with respect to FIGS. 19B, 20A, 20B, 21A and 21B, and have the same and/or similar structure and function with respect to the exemplary embodiment of the wheeled lifting device 410 shown in FIGS. 27-29 that was previously discussed with respect to the exemplary embodiment of the wheeled lifting device 310 from FIGS. 19B, 20A, 20B, 21A and 21B, and therefore such discussion is not repeated.

Referring again to FIGS. 27-29, the wheeled lifting device 310 includes a tab 440 extended from and positioned on the lever 330 that is pivotably connected to a yoke 442 attached to an end of the cable 417 that connects the wheeled lifting device 310 with the modified wheeled lifting device 401. The opposite end of the cable 417 also includes a yoke 443 that is pivotably connected to an extension 445 from the eccentric cam 324 of the modified wheeled lifting device 401. As discussed further below, it is understood that through the connection of the lever 330 on the wheeled lifting device 310 to the eccentric cam 324 of the modified wheeled lifting device 401 by the cable 417 that when the lever 330 on the wheeled lifting device 310 is actuated, it will cause angular movement of both the eccentric cam 324 of the wheeled lifting device 310 and the eccentric cam 324 of the modified wheeled lifting device 401 in order to permit dual actuation of the platforms 312 of the wheeled lifting device 410. The modified wheeled lifting device 401 may also include a strut 447 positioned so as to connect the bracket 311 and the platform 312 so as to provide additional resistance to movement of the modified lifting device 401 into the retracted positioned, as discussed further below.

Figure 30:
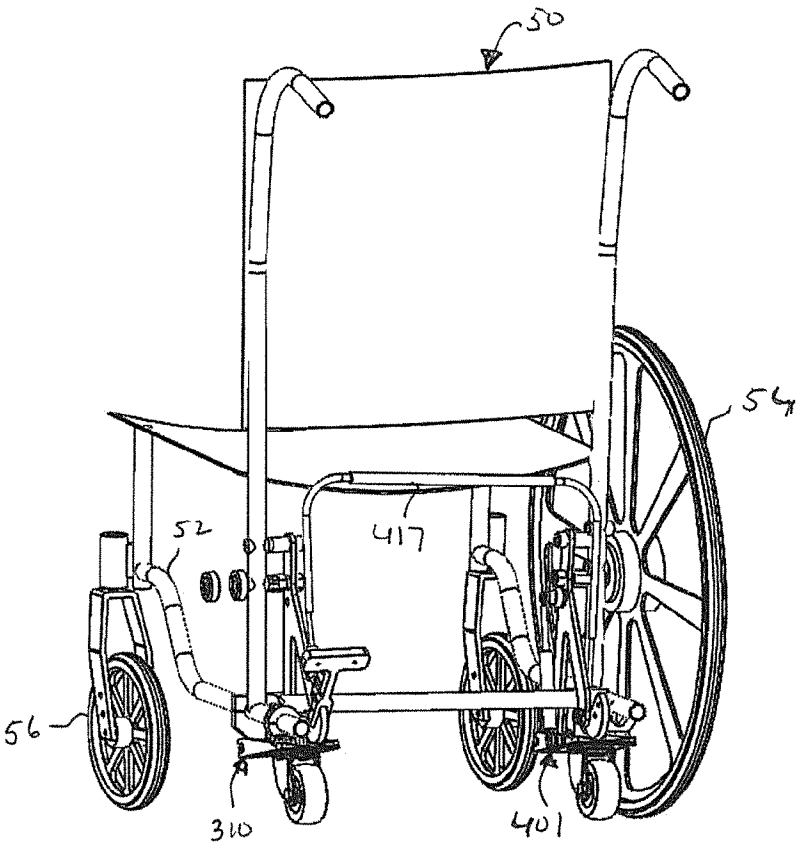
FIG. 30 is a rear isometric view of the other exemplary wheeled lifting device in a retracted configuration installed on an exemplary wheelchair.
Figure 31:
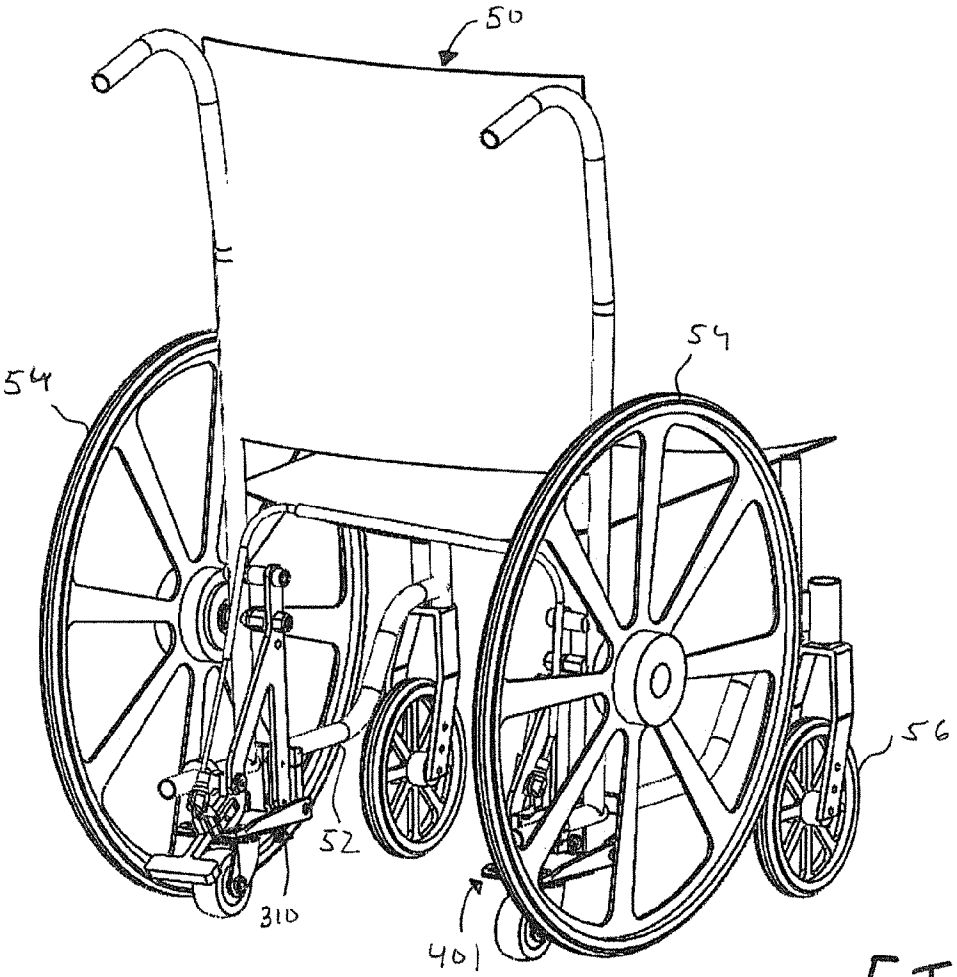
FIG. 31 is an opposite rear isometric view of the other exemplary wheeled lifting device in an extended configuration installed on the exemplary wheelchair.
Figure 32:
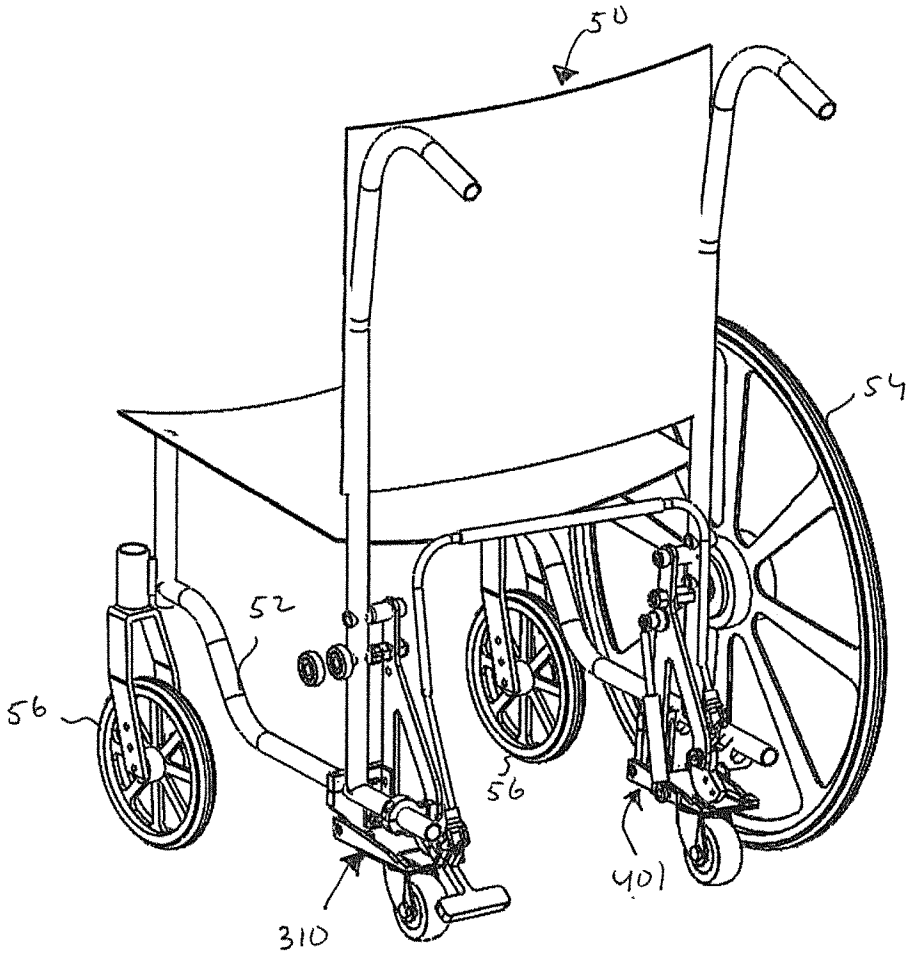
FIG. 32 is a side isometric view of the other exemplary wheeled lifting device in a retracted configuration installed on the exemplary wheelchair.
Figure 33:
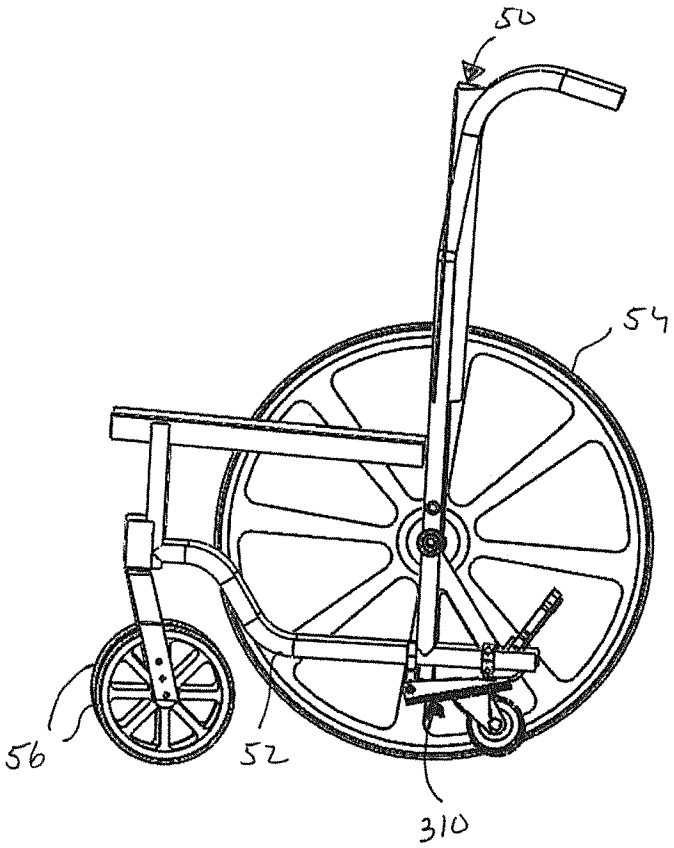
FIG. 33 is a side view of the other exemplary wheeled lifting device in a retracted configuration installed on the exemplary wheelchair.
Figure 34:
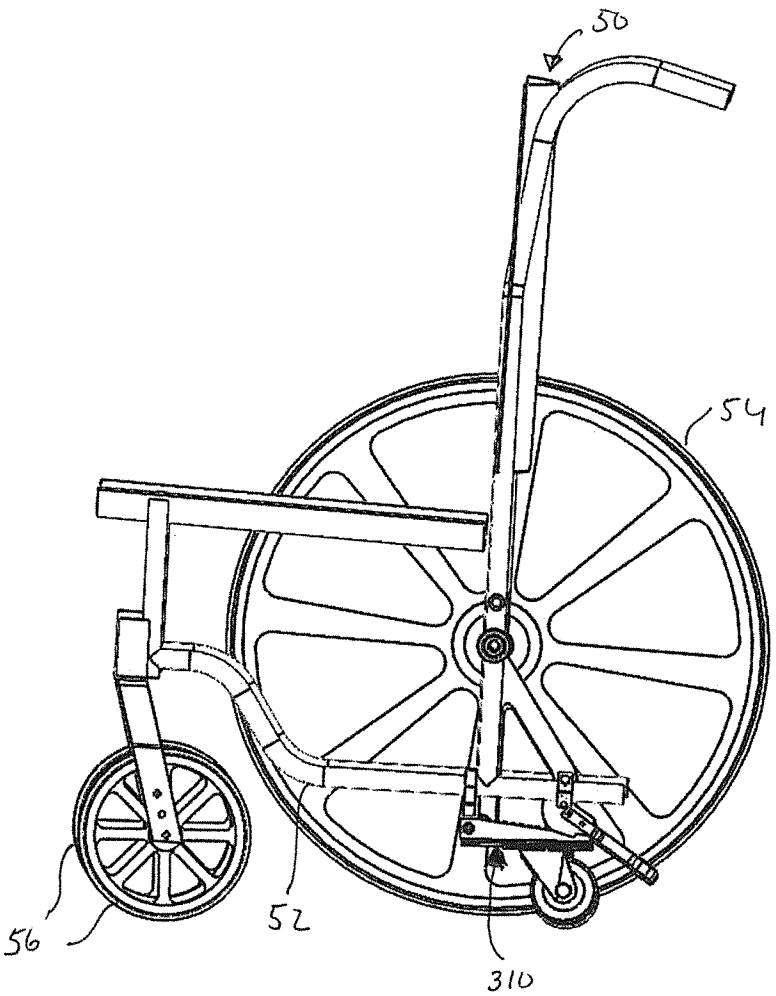
FIG. 34 is a side isometric view of the other exemplary wheeled lifting device in an extended configuration installed on the exemplary wheelchair.
Figure 35:
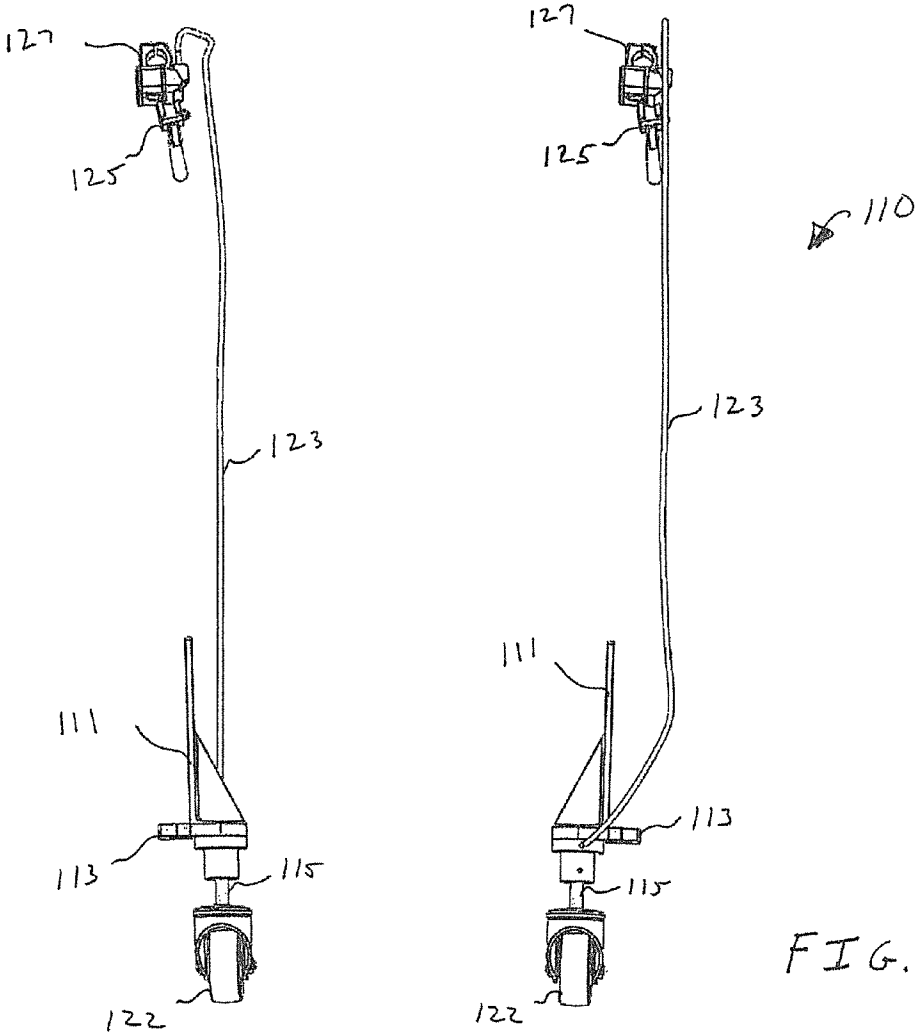
FIG. 35 is a back view of another alternative exemplary wheeled lifting device that may be actuated by hydraulics in an extended configuration according to the present invention.
Figure 36:
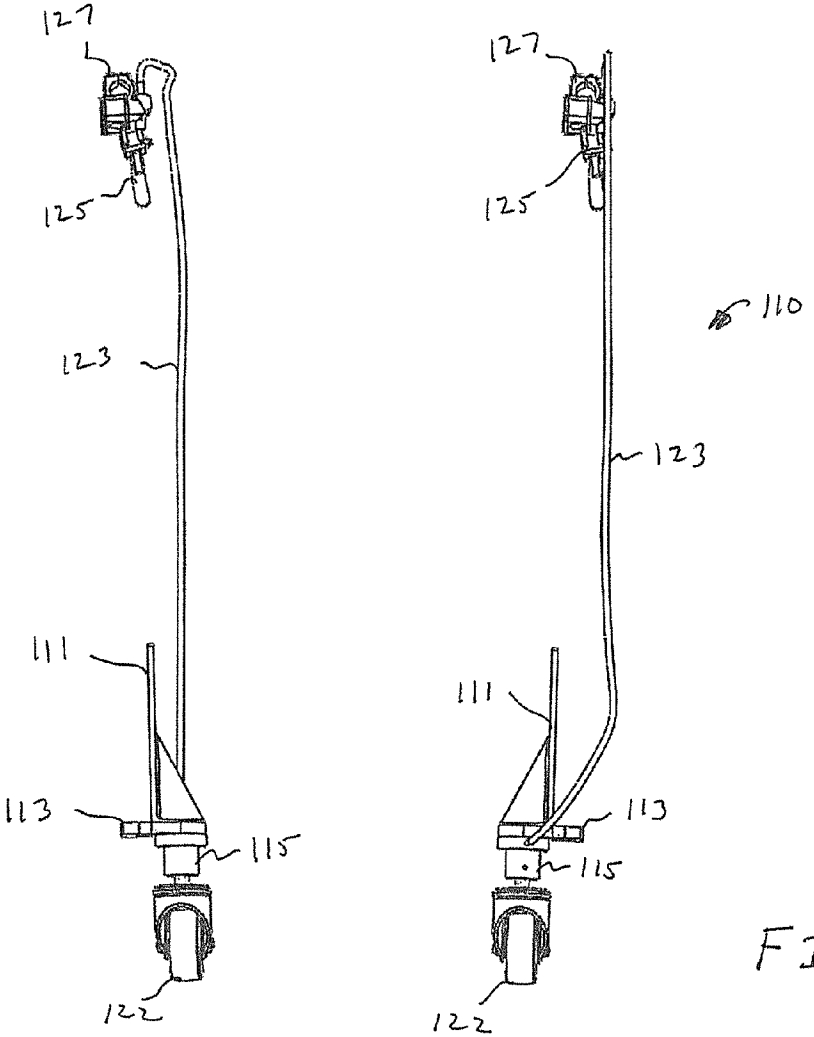
FIG. 36 is a back view of the exemplary hydraulic wheeled lifting device in a retracted configuration according to the present invention.
Figure 37:
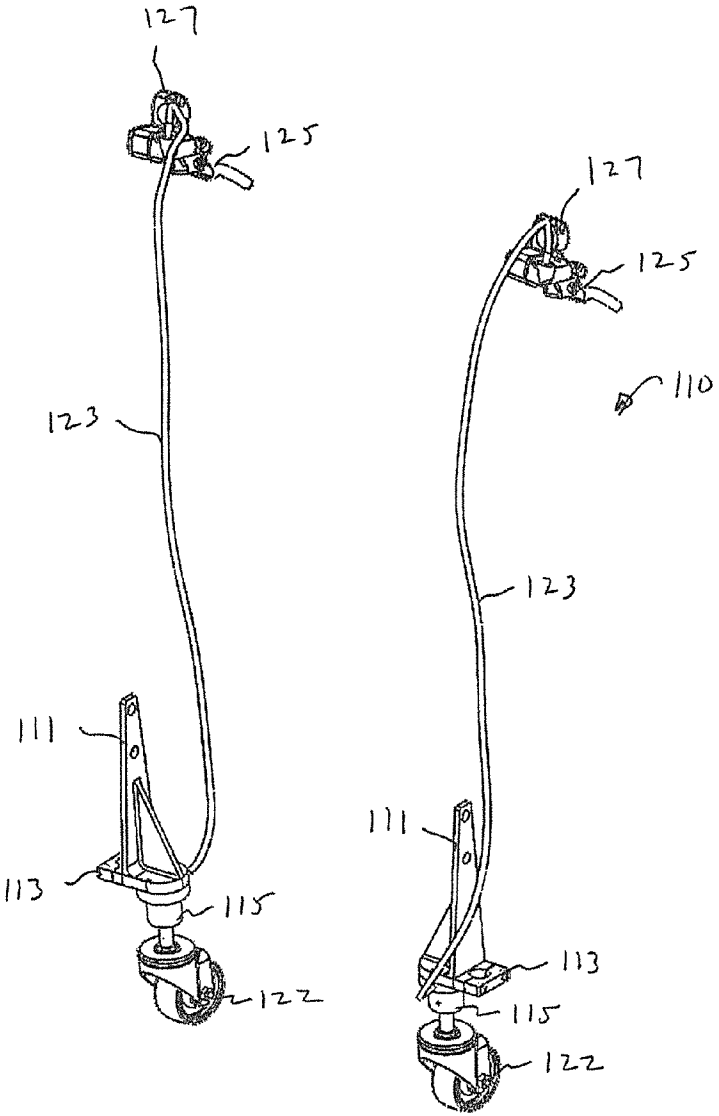
FIG. 37 is an isometric view of the exemplary hydraulic wheeled lifting device in an extended configuration according to the present invention.
Figure 38:
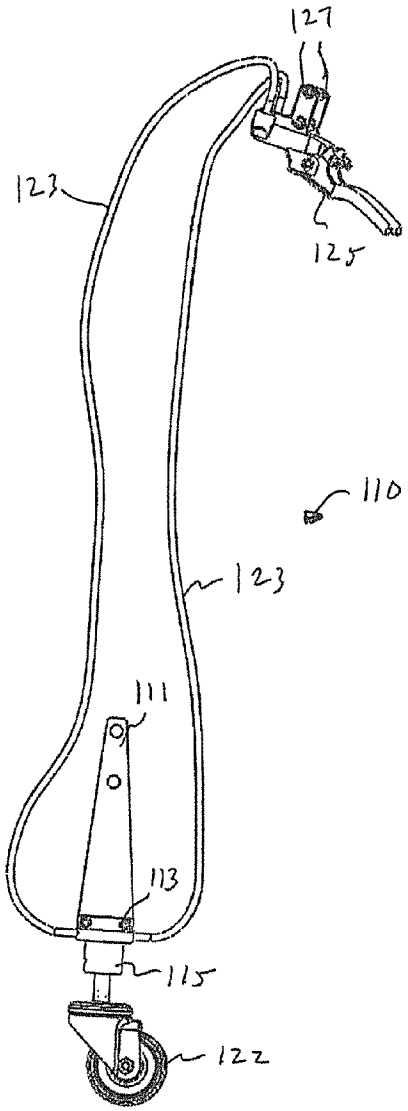
FIG. 38 is a side view of the exemplary hydraulic wheeled lifting device in an extended configuration according to the present invention.
Figure 39:
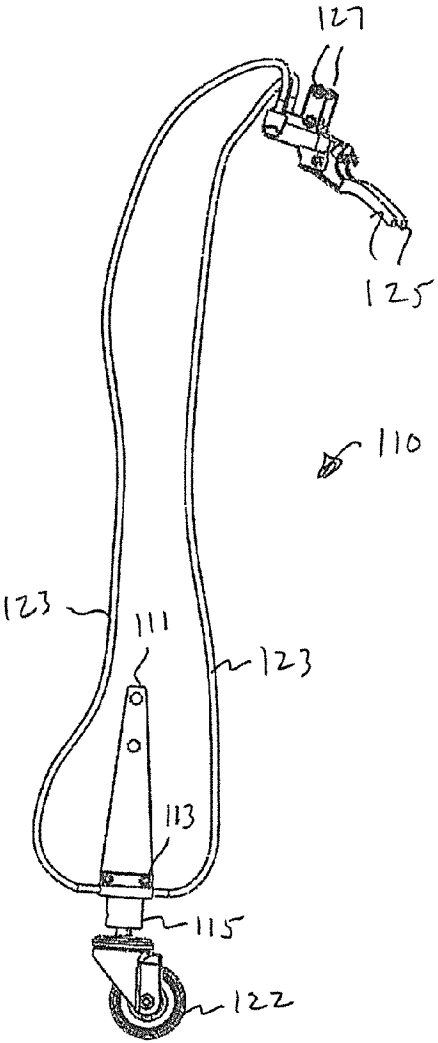
FIG. 39 is a side view of the exemplary hydraulic wheeled lifting device in a retracted configuration according to the present invention.
Figure 40:
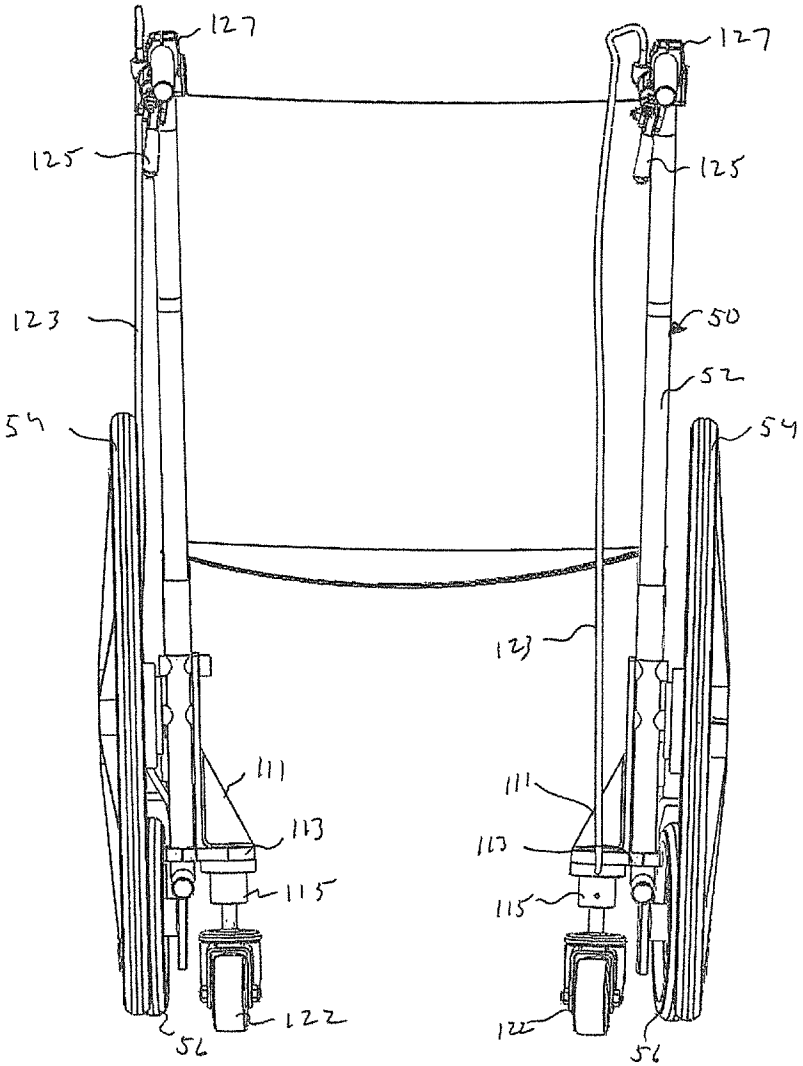
FIG. 40 is a back view of the exemplary hydraulic wheeled lifting device in an extended configuration according to the present invention installed on an exemplary wheel chair.
Figure 41:
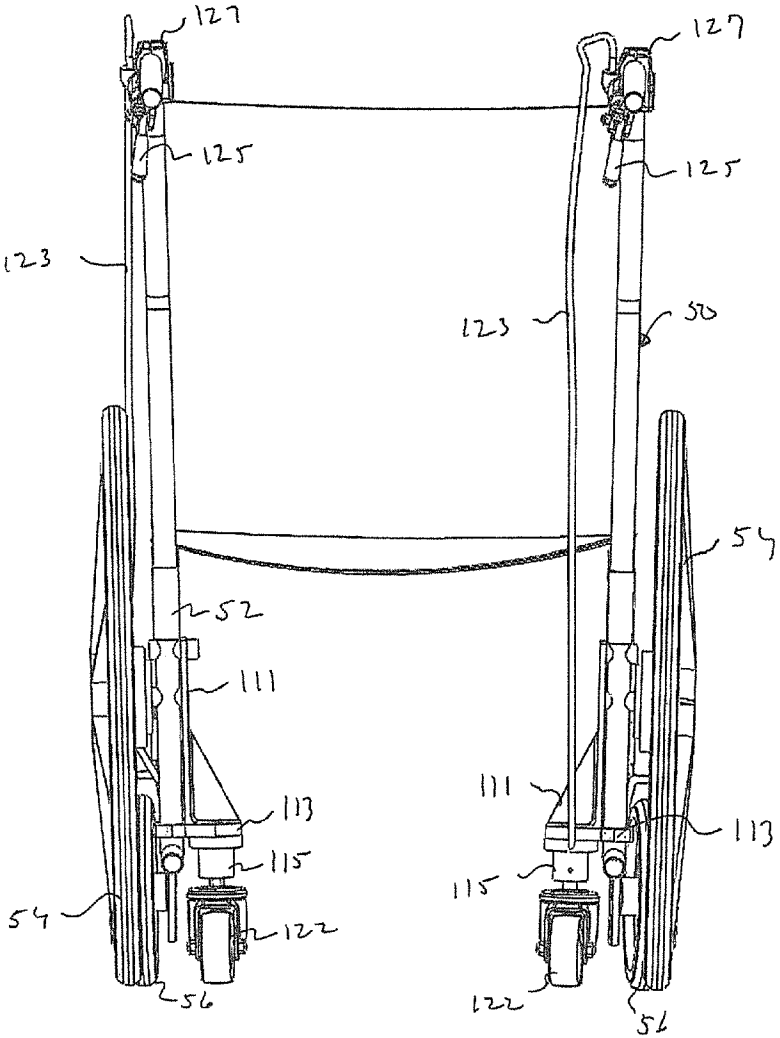
FIG. 41 is a back view of the exemplary hydraulic wheeled lifting device in a retracted configuration according to the present invention installed on an exemplary wheel chair.
Figure 42:
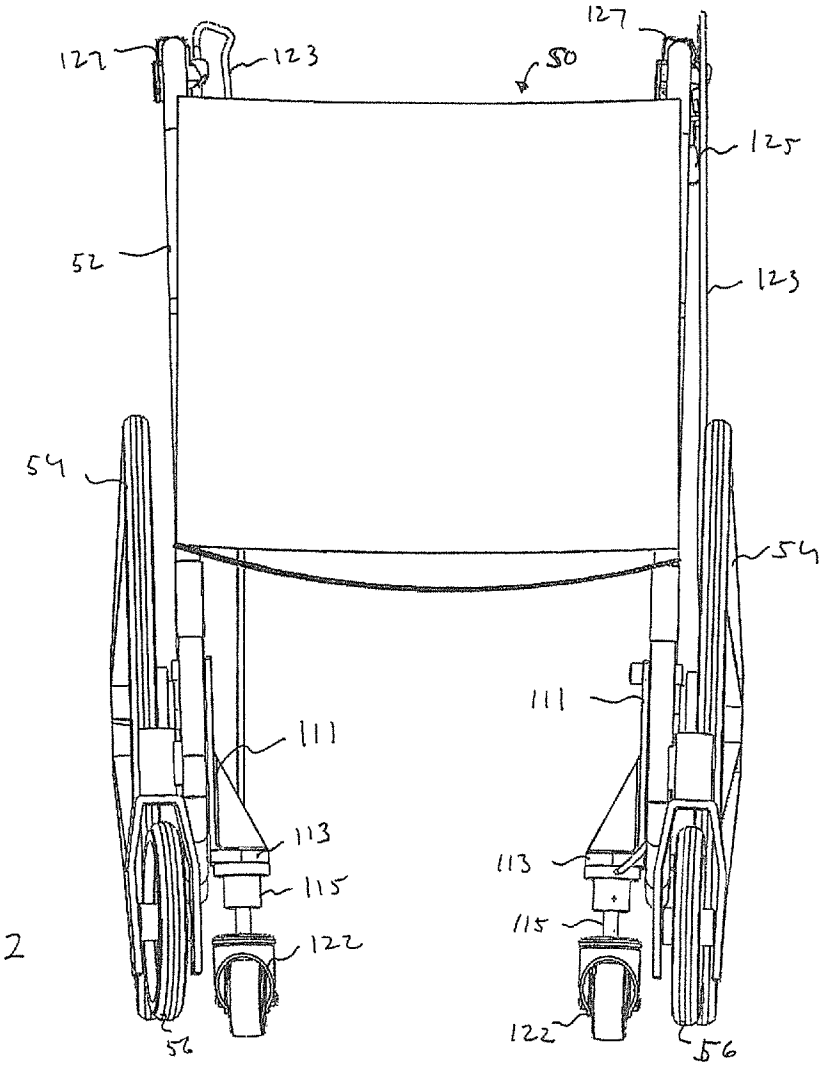
FIG. 42 is a front view of the exemplary hydraulic wheeled lifting device in an extended configuration according to the present invention installed on an exemplary wheel chair.
Figure 43:
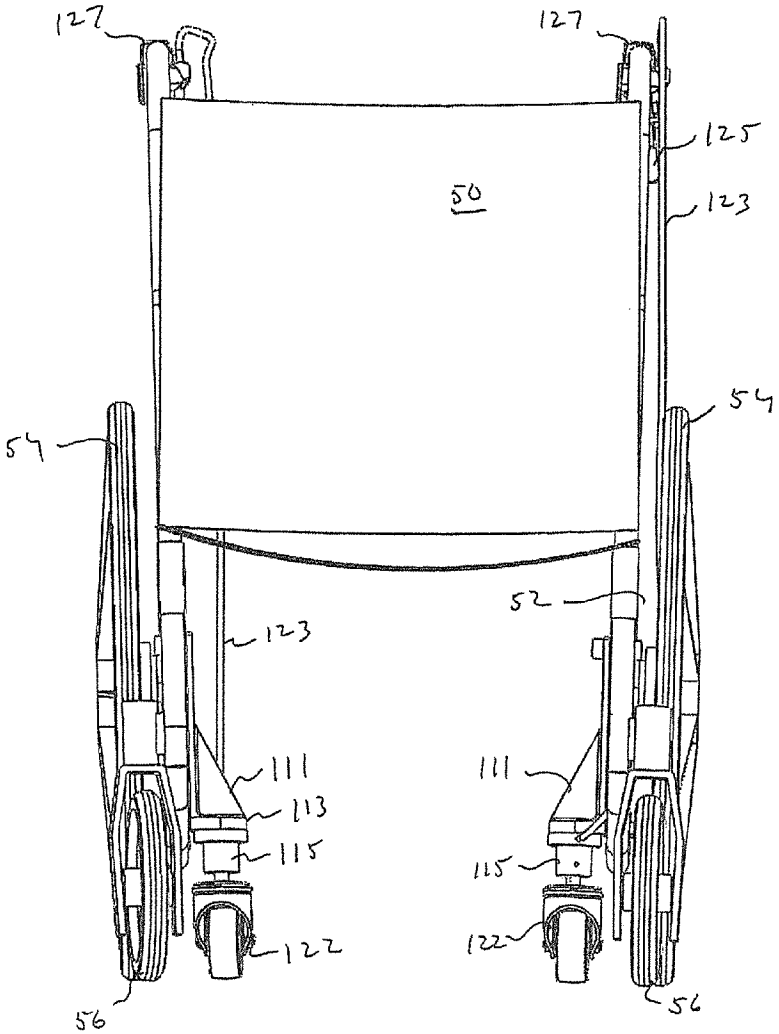
FIG. 43 is a front view of the exemplary hydraulic wheeled lifting device in a retracted configuration according to the present invention installed on an exemplary wheel chair.
Figure 44:
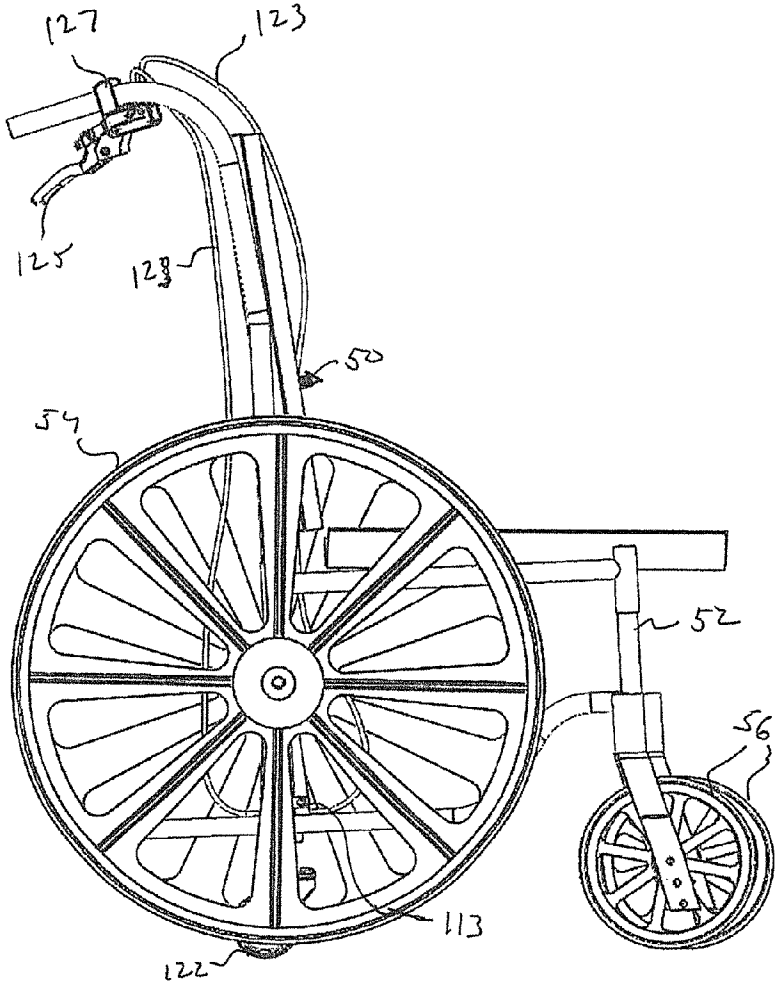
FIG. 44 is a side view of the exemplary hydraulic wheeled lifting device in an extended configuration according to the present invention installed on an exemplary wheel chair.
Figure 45:
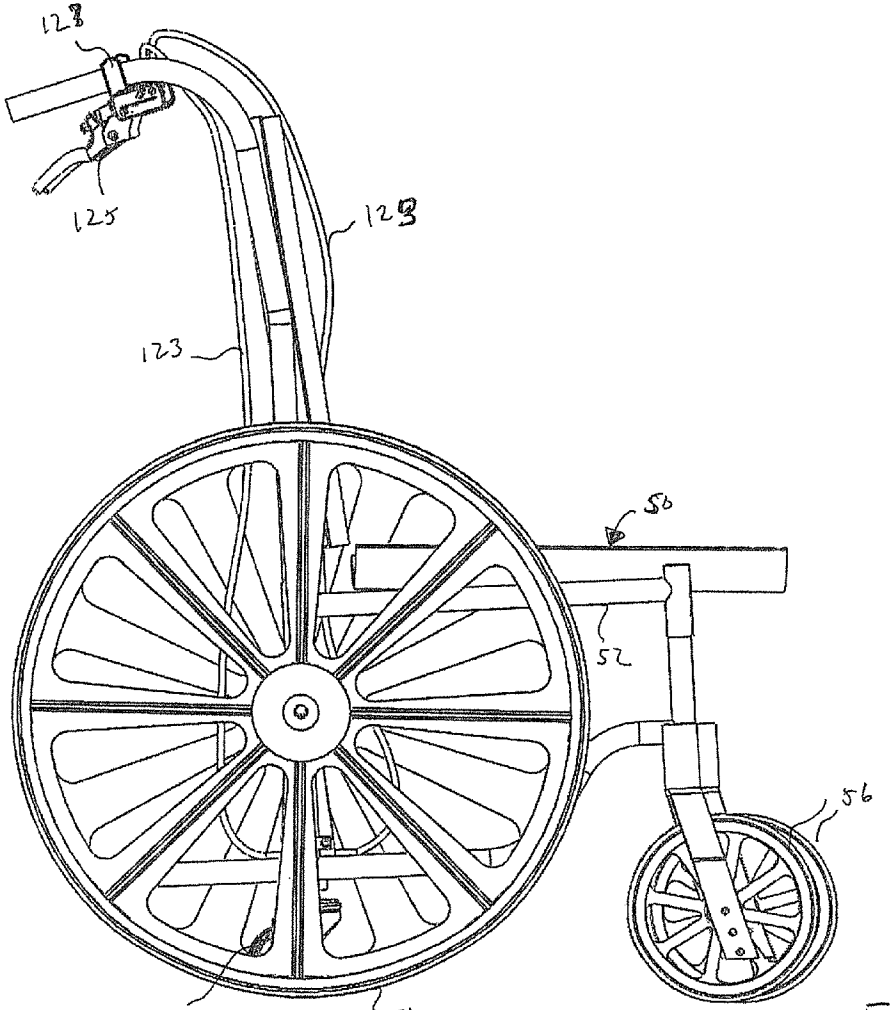
FIG. 45 is a side view of the exemplary hydraulic wheeled lifting device in a retracted configuration according to the present invention installed on an exemplary wheel chair.
Figure 46:
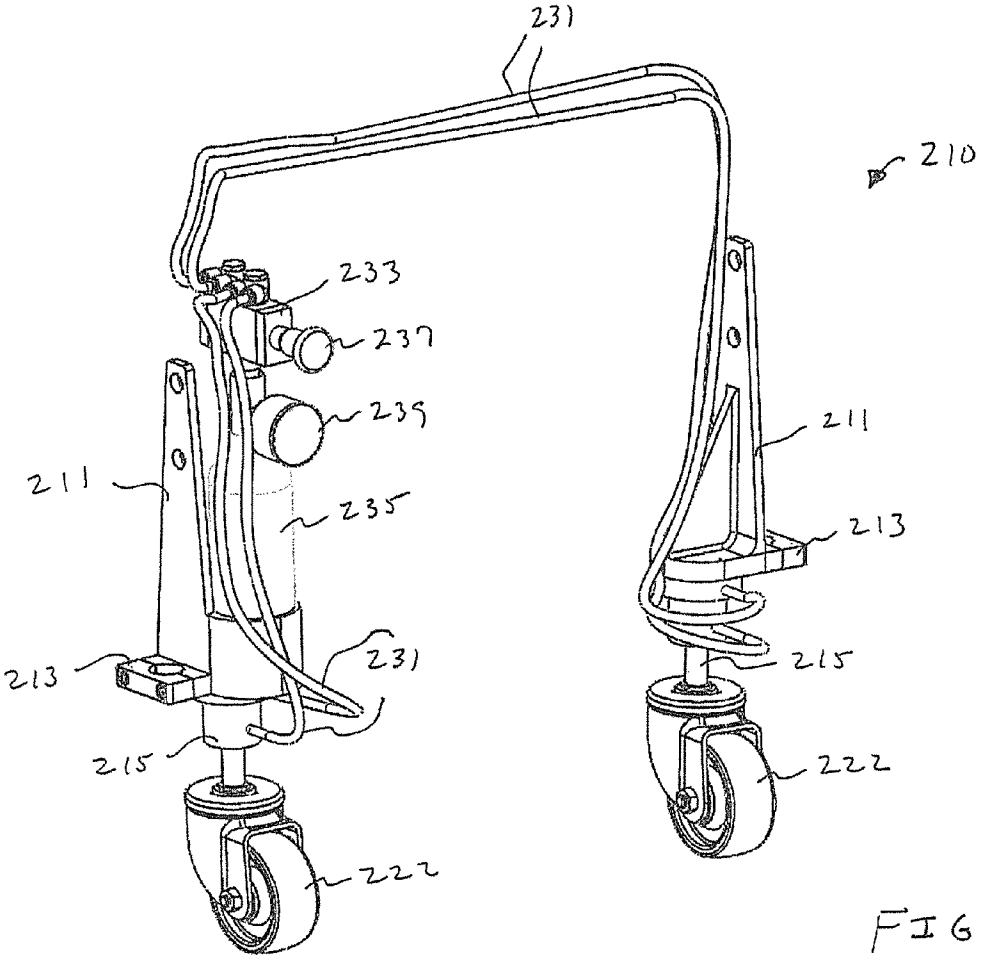
FIG. 46 is an isometric view of another alternative exemplary wheeled lifting device that may be actuated by air pressure in an extended configuration according to the present invention.
Figure 47:
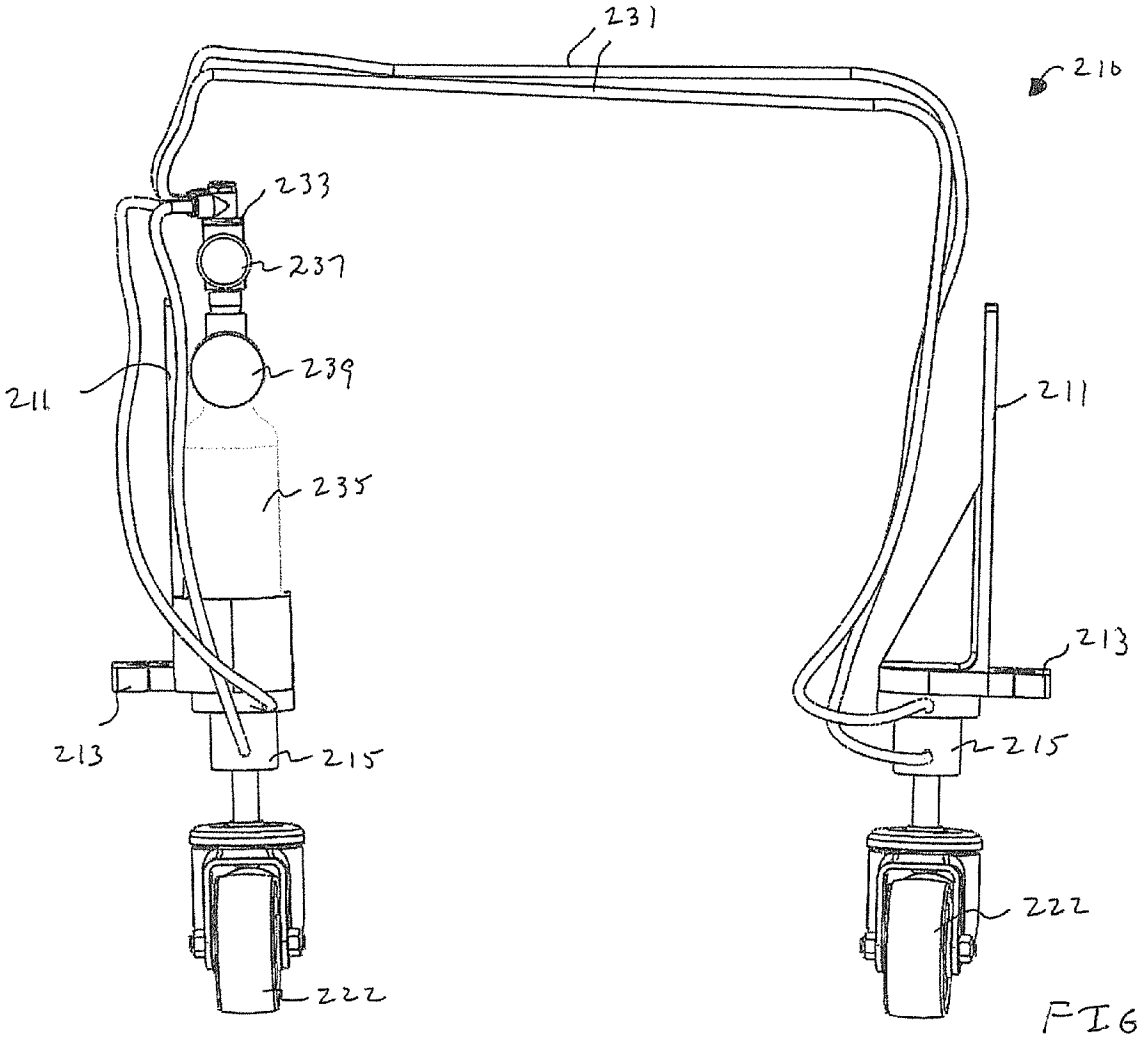
FIG. 47 is a back view of the exemplary air-operated wheeled lifting device in an extended configuration according to the present invention.
Figure 48:
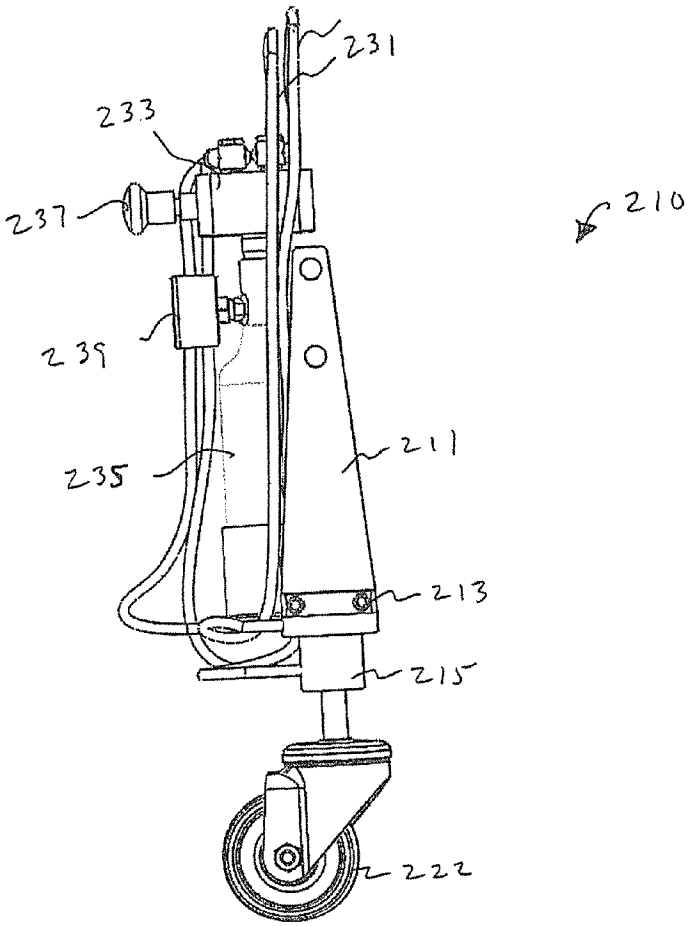
FIG. 48 is a side view of the exemplary air-operated wheeled lifting device in an extended configuration according to the present invention.
Figure 49:
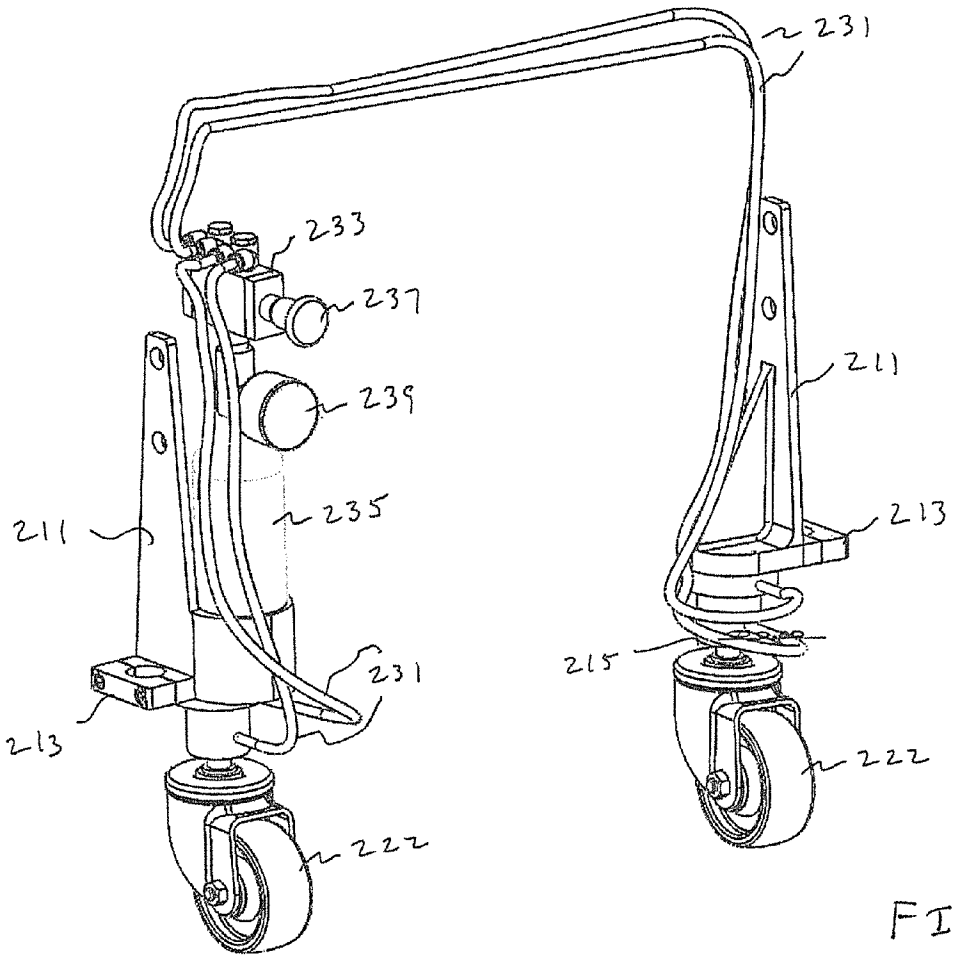
FIG. 49 is an isometric view of the exemplary air-operated wheeled lifting device in a retracted configuration according to the present invention.
Figure 50:
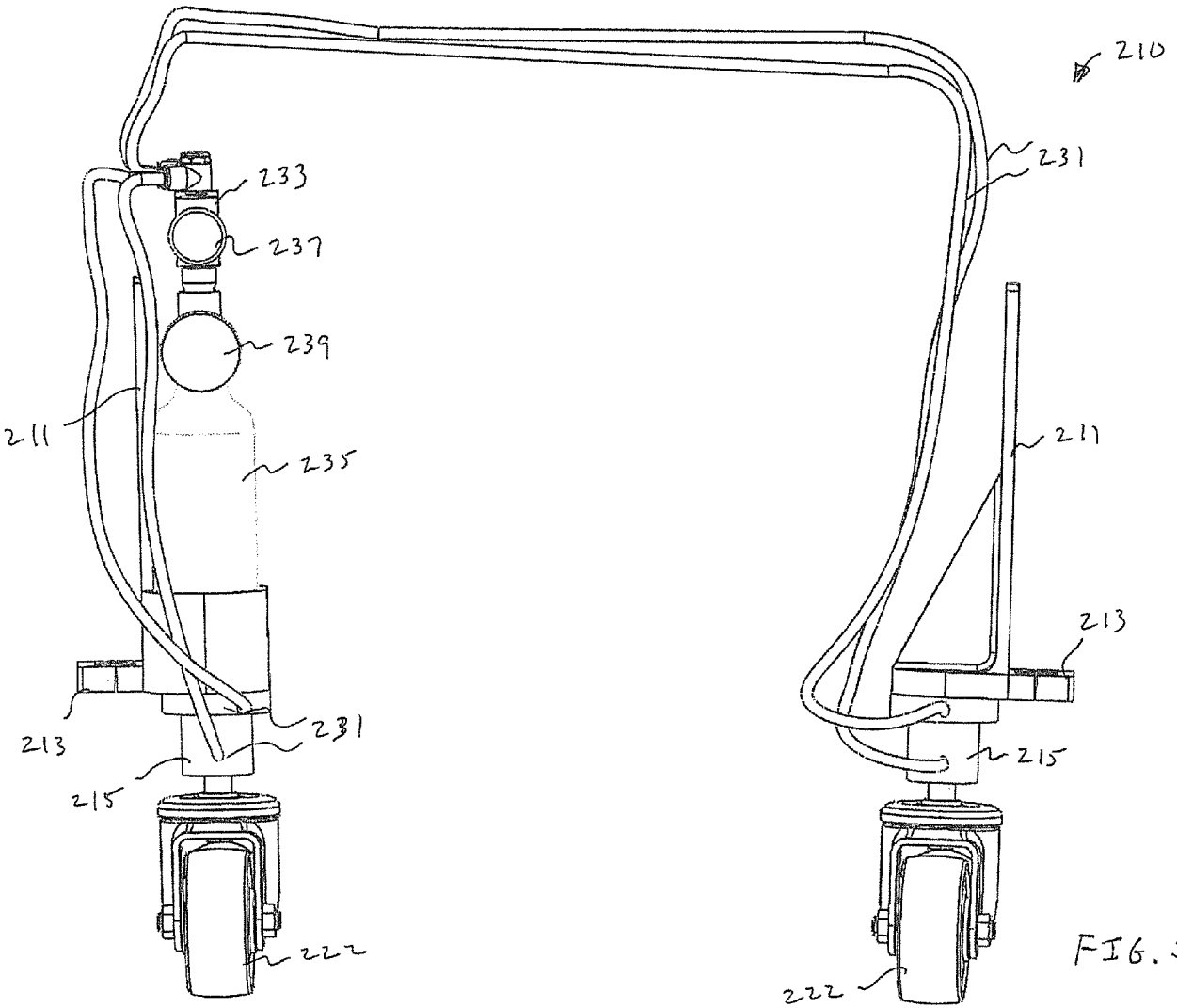
FIG. 50 is a rear view of the exemplary air-operated wheeled lifting device in a retracted configuration according to the present invention.
Figure 51:
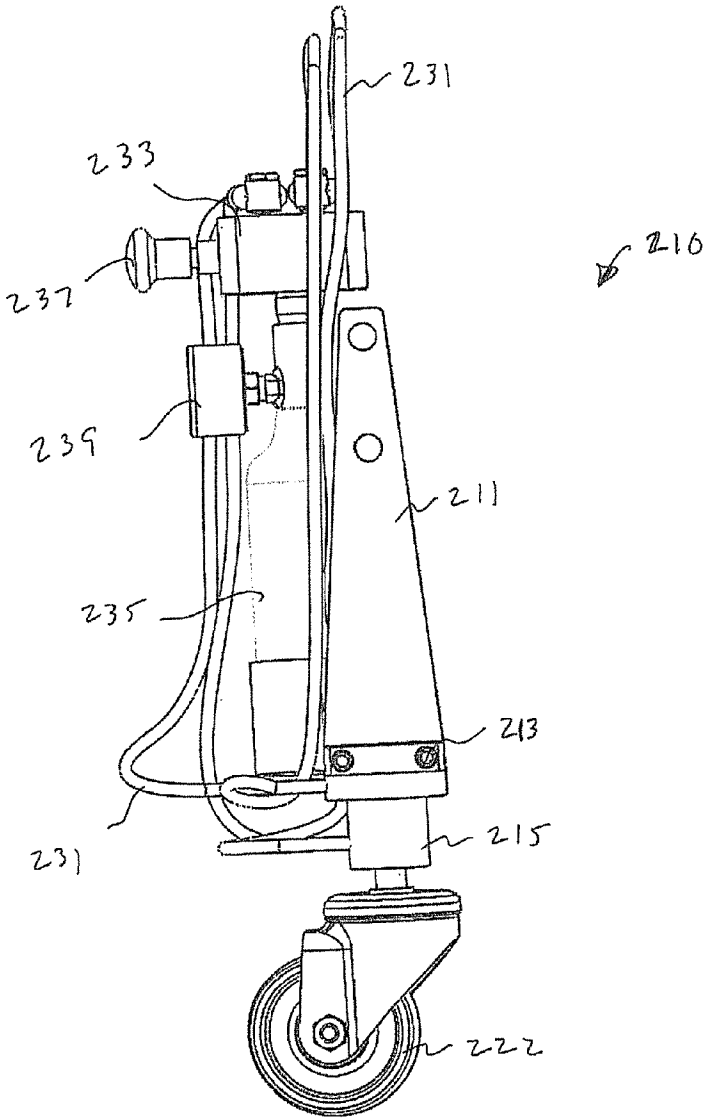
FIG. 51 is a side view of the exemplary air-operated wheeled lifting device in a retracted configuration according to the present invention.
Figure 52:
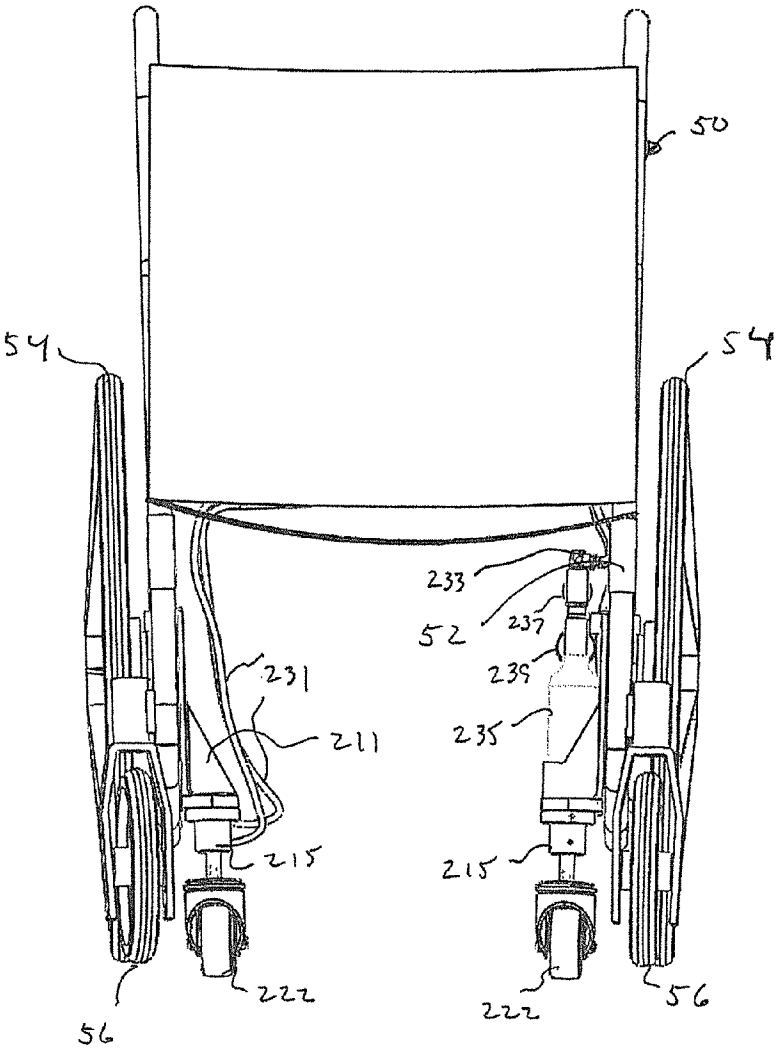
FIG. 52 is a front view of the exemplary air-operated wheeled lifting device in an extended configuration according to the present invention installed on an exemplary wheel chair.
Figure 53:
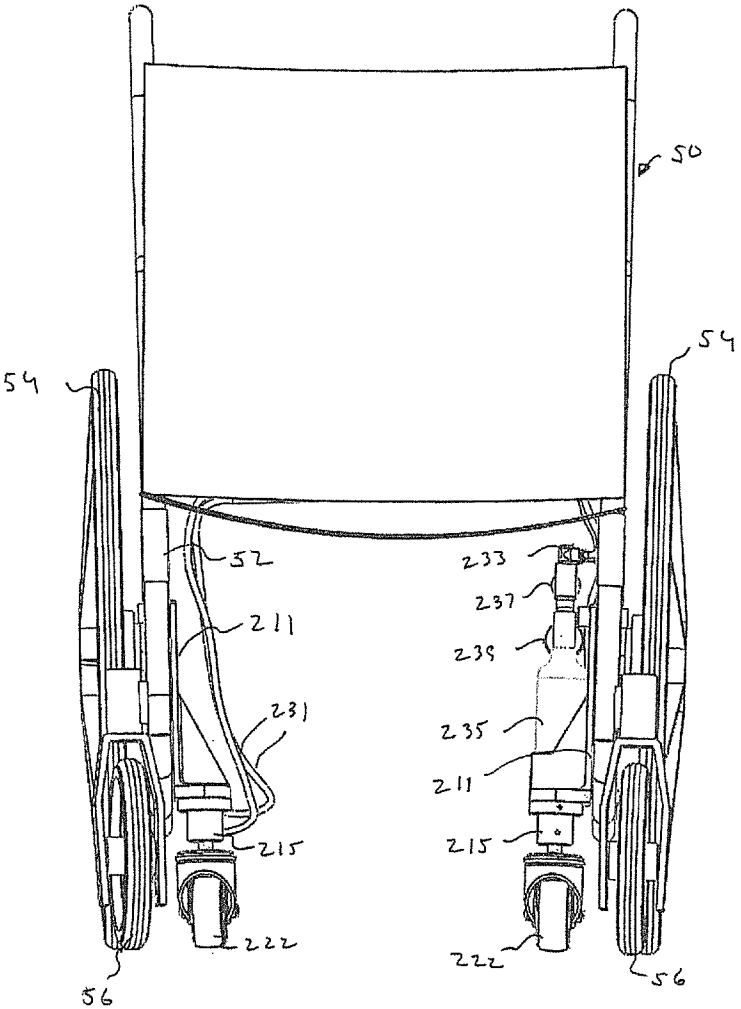
FIG. 53 is a front view of the exemplary air-operated c wheeled lifting device in a retracted configuration according to the present invention installed on an exemplary wheel chair.
Figure 53A:
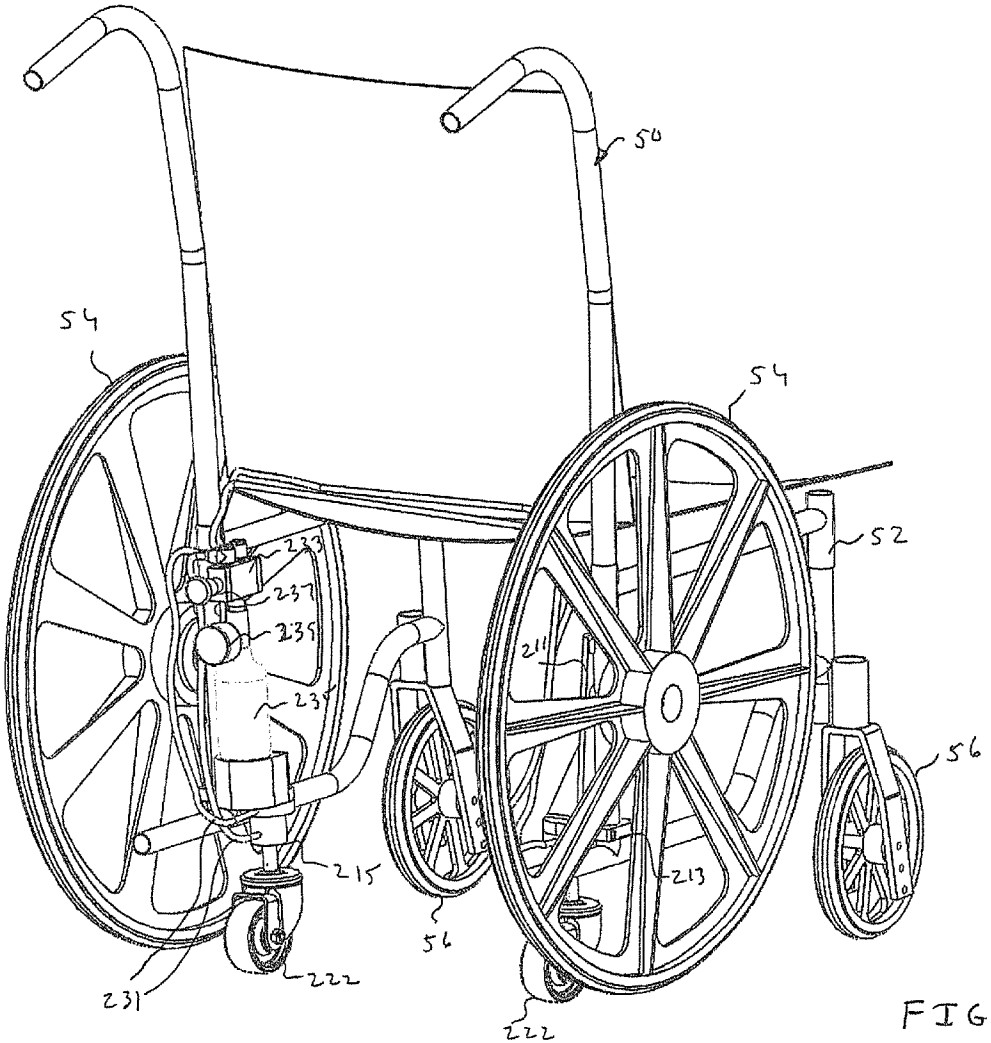
FIG. 53A is an isometric view of the exemplary air-operated wheeled lifting device in an extended configuration according to the present invention installed on an exemplary wheel chair.
Figure 54:
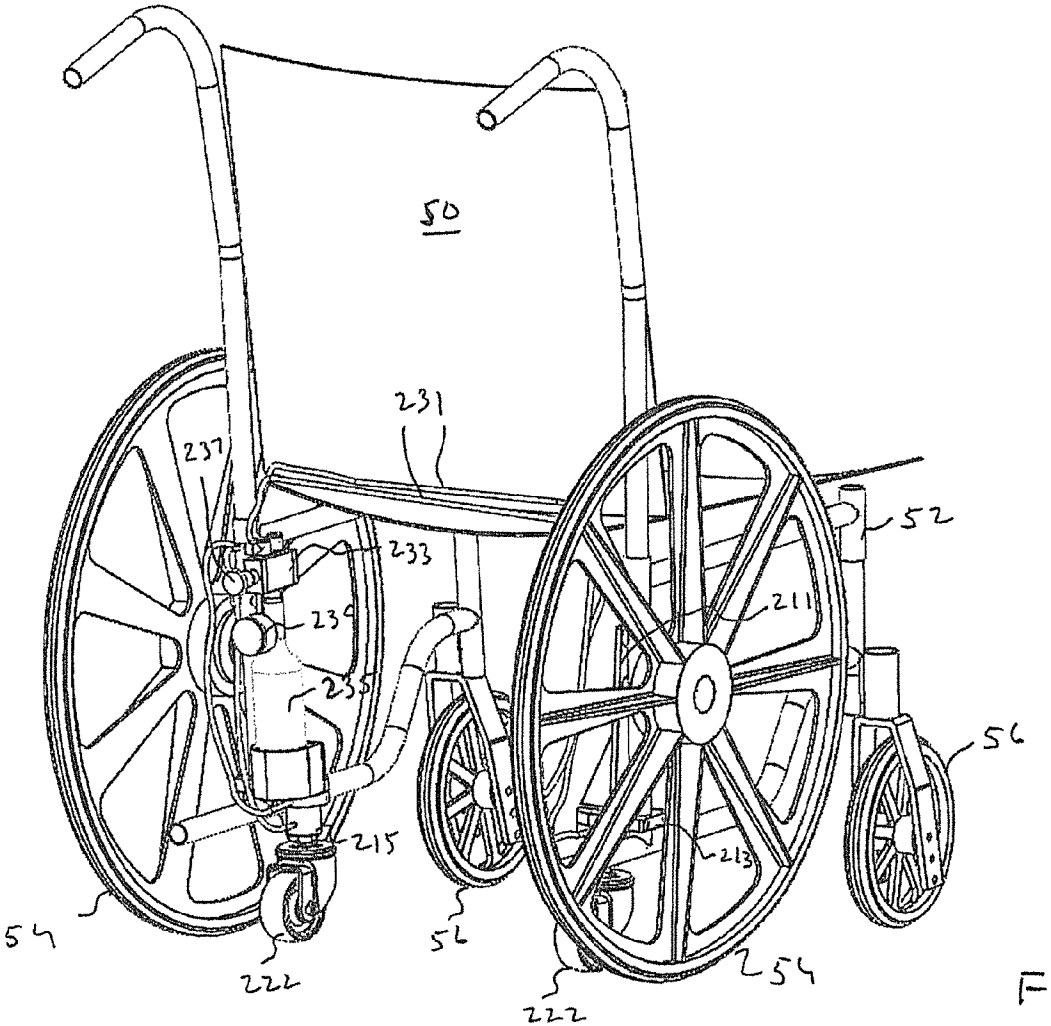
FIG. 54 is an isometric view of the exemplary air-operated wheeled lifting device in a retracted configuration according to the present invention installed on an exemplary wheel chair.
Figure 55:
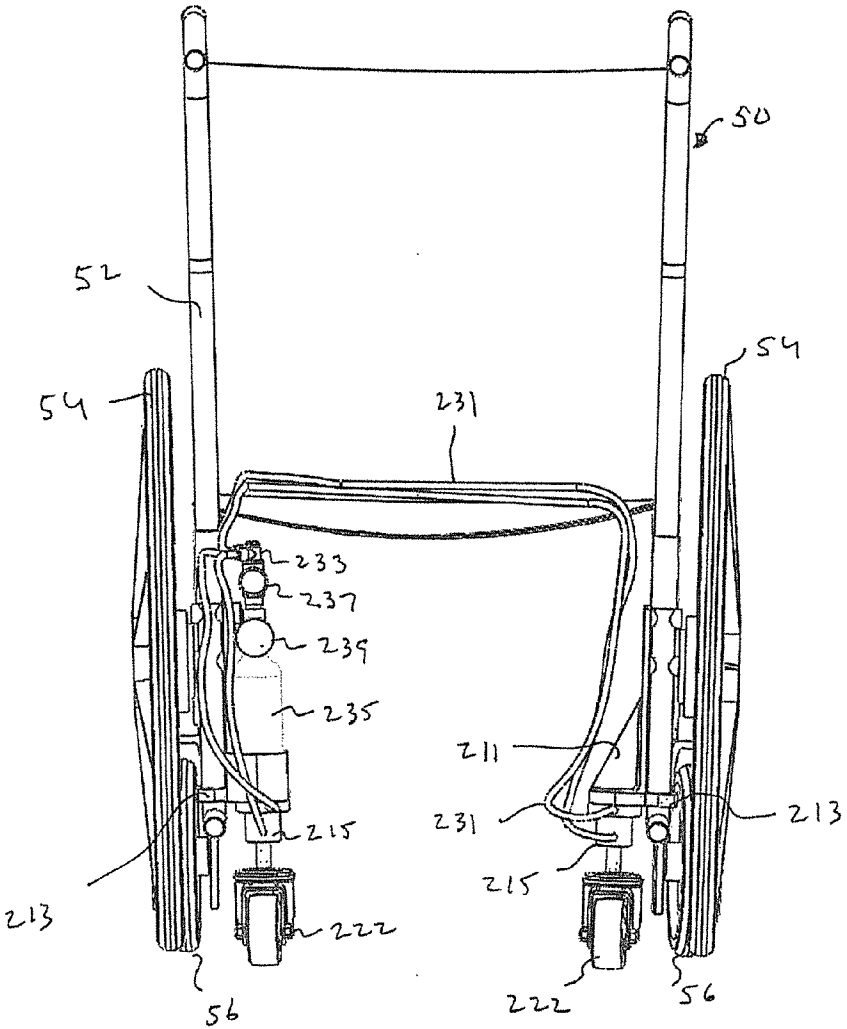
FIG. 55 is a rear view of the exemplary air-operated wheeled lifting device in an extended configuration according to the present invention installed on an exemplary wheel chair.
Figure 56:
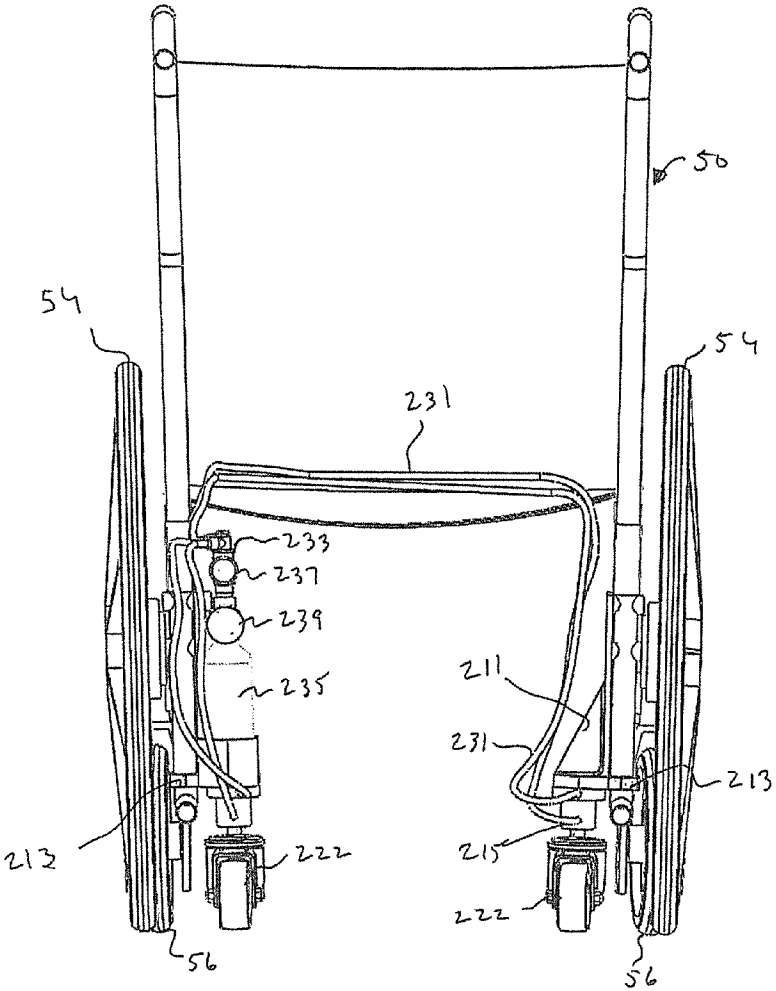
FIG. 56 is a rear view of the exemplary air-operated wheeled lifting device in a retracted configuration according to the present invention installed on an exemplary wheel chair.
Figure 57:
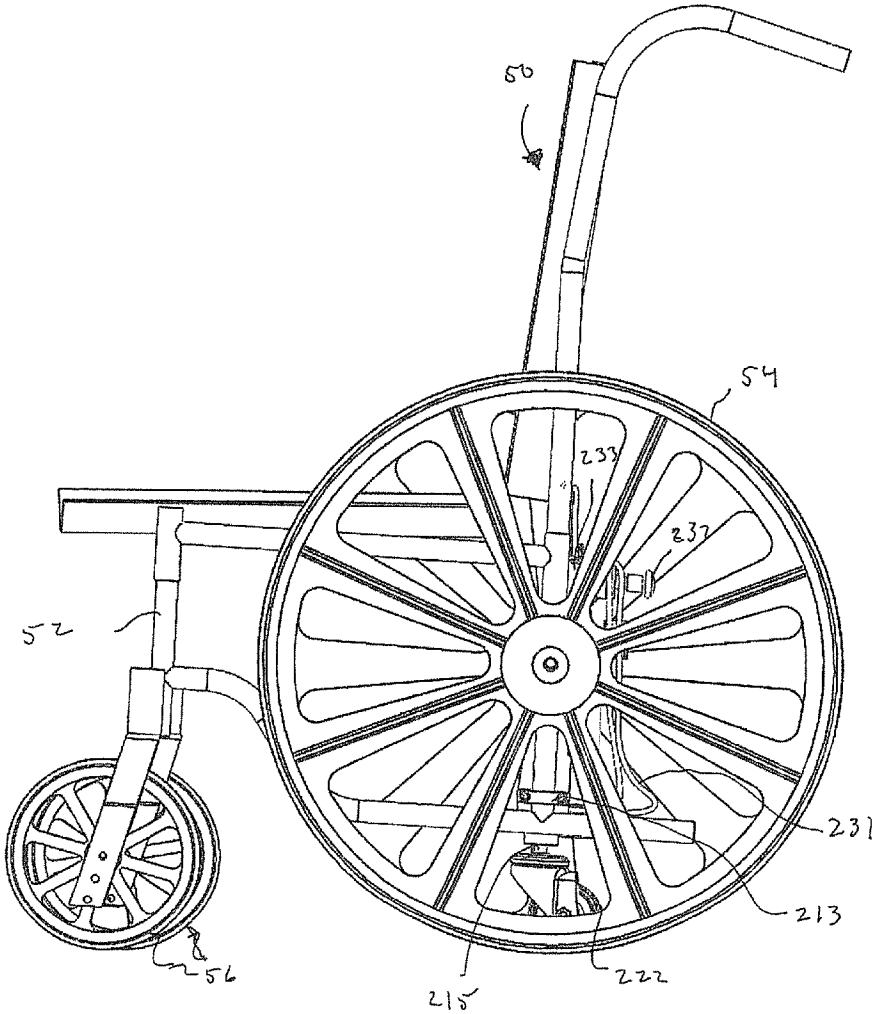
FIG. 57 is a rear view of the exemplary air-operated wheeled lifting device in a retracted configuration according to the present invention installed on an exemplary wheel chair.

The installation, operation and use of the wheeled lifting device 410 will now be discussed with reference to FIGS. 30-32. The wheeled lifting device 410 may be installed on a device, such as a wheelchair 50 by attaching the clamping mechanisms 316 and supports 328 of the wheeled lifting device 310 and modified wheeled lifting device 401 to the structure 52 of the wheelchair 50. The wheeled lifting device 410 may also be secured to the structure 52 of the wheelchair 50 by using suitable fasteners to also attach the brackets 311 of the wheeled lifting device 310 and modified wheeled lifting device 401 to the structure 52 of the wheelchair 50. It is understood that one of the rear wheels 54 of the wheelchair 50 is not illustrated in FIGS. 30 and 32 in order to allow a better view of the wheeled lifting device 410 installed on the wheelchair 50. Once attached to the wheelchair 50, the wheeled lifting device 410 may be positioned in a retracted configuration, as shown for example in FIG. 30, in which the multi-directional wheels 322 are positioned above or even with the rear wheels 54 of the wheelchair 50. In the retracted configuration, the multi-directional wheels 322 either do not contact a surface on which the rear wheels 54 of the wheelchair 50 are positioned or contact the surface in combination with the rear wheels 54. When in the retracted configuration, the wheeled lifting device 410 permits the wheelchair 50 to operate in the normal manner as understood by those skilled in the art. In order to move the wheeled lifting device 410 into an extended configuration, as shown for example in FIGS. 31-32, the lever 330 of the wheeled lifting device 310 is depressed in a direction towards the surface on which the wheelchair 50 is positioned in order to cause angular movement of the eccentric cam 324 about the pivot bar 326 of the wheeled lifting device 310. The eccentric cam 324 may be configured for movement relative to the pivot bar 326 so that the eccentric cam 324 pivots about the point and/or area through which the pivot bar 326 passes through the eccentric cam 324, or in the alternative, the pivot bar 326 may be fixed to the eccentric cam 324 and the pivot bar 326 rotates relative to the supports 328. Since the eccentric cam 324 is eccentric with respect to the pivot bar 326, such angular movement of the eccentric cam 324 urges the platform 312 away from the pivot bar 326 as a result of the eccentric cam 324 bearing upon the platform 312, and this bearing causes the platform 312 to pivot about the connection to the clamping mechanism 316. Since the clamping mechanism 316 of the wheeled lifting devices 310 is secured to the structure 52 of the wheelchair 50, and the platform 312 of the wheeled lifting device 310 is movable relative to the wheelchair 50, the angular movement of the platform 312 causes the multi-directional wheels 322 to move into the extended configuration in which the multi-directional wheels 322 extend out past the rear wheels 54 of the wheelchair 50, and lift the rear wheels 54 of the wheelchair 50 off of the surface on which the rear wheels 54 have been in contact with so that only the multi-directional wheels 322 are in contact with the surface. In turn, the movement of the lever 330 of the wheeled lifting device 310 also pulls the cable 417 in the direction in which the lever 330 is moved as a result of the attachment of the cable 417 to the lever 330. This pulling of the cable 417 is then transferred to the eccentric cam 324 of the modified wheeled lifting device 401, thereby causing angular movement of the eccentric cam 324, which likewise causes extension of the multi-directional wheel 322 of the modified wheeled lifting device 401. In this manner, the movement of the wheelchair 50 may now be controlled with respect to the multi-directional wheels 322 and the front wheels 56 of the wheelchair 50, which allows for multi-directional movement and tight turning of the wheelchair 50. The wheeled lifting device 310 may be secured in the extended position by the friction of the eccentric cam 324 against the platform 312 and having been wedged into such extended position through the action upon the lever 330, and the modified wheeled lifting device 401 may likewise be secured in the extended position by the friction of the eccentric cam 324 against the platform 312 and support from the strut 447 as necessary. In order to return the wheeled lifting device 310 the retracted configuration, the lever 330 may be lifted in a direction away from the surface on which the multi-directional wheels 322 are positioned in order to move the eccentric cam 324 angularly to allow the platform 312 to also move angularly relative to the clamping mechanisms 316 in order to withdraw the multi-directional wheels 322 either even with or above the rear wheels 54 of the wheelchair 50. In turn, the movement of the lever 330 in a direction away from the surface releases the pull of the cable 417 upon the eccentric cam 324 of the modified wheeled lifting device 401, thereby releasing the platform 312 of the modified wheeled lifting device 401 from the extended position.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A wheeled lifting device, comprising:

at least one multi-directional wheel; and an extension mechanism operatively coupled to the at least one multi-directional wheel and to a frame of a wheelchair having a first pair of wheels and a second pair of wheels; and a control mechanism operatively coupled to the extension mechanism;

wherein the control mechanism is operable to position the extension mechanism in a fixed retracted configuration in which the first pair of wheels and the second pair of wheels of the wheelchair are in a lowered position in contact with a ground surface or a fixed extended configuration in which the first pair of wheels of the wheelchair are in a raised position no longer in contact with the ground surface;

wherein in the fixed retracted configuration of the extension mechanism the at least one multi-directional wheel is in a first fixed position not in contact with the ground surface, and in the fixed extended configuration of the extension mechanism the at least one multi-directional wheel is in a second fixed position in contact with the ground surface; and wherein the extension mechanism is not positionable in the fixed retracted configuration or the fixed extended configuration except through operation of the control mechanism.

2. The wheeled lifting device according to claim 1, wherein the extension mechanism comprises an eccentric cam, a pivot bar extending through the eccentric cam and a platform operatively coupled to the at least one multi-directional wheel, wherein the platform is operatively engaged with the eccentric cam and movable relative to the eccentric cam.

3. The wheeled lifting device according to claim 2, wherein the eccentric cam is configured for angular movement about the pivot bar, and the angular movement of the eccentric cam causes positioning of the extension mechanism between the retracted configuration and the extended configuration.

4. The wheeled lifting device according to claim 2, wherein the pivot bar is connected to at least one support configured for attachment to the frame of the wheelchair.

5. The wheeled lifting device according to claim 4, wherein the extension mechanism is positionable between the fixed retracted configuration and the fixed extended configuration relative to the frame of the wheelchair.

6. The wheeled lifting device according to claim 2, wherein the control mechanism comprises a lever operatively coupled to the eccentric cam and configured to cause angular movement of the eccentric cam about the pivot bar when a force is applied to the lever.

7. The wheeled lifting device according to claim 6, further comprising a cable operatively coupled to the lever at a first end of the cable and operatively coupled to a second eccentric cam at a second end of the cable, and wherein movement of the lever is transferred to angular movement of the second eccentric cam by the cable.

8. The wheeled lifting device according to claim 1, wherein the extension mechanism comprises a pneumatic activation mechanism operatively coupled to the at least one multi-directional wheel.

9. The wheeled lifting device according to claim 8, wherein the pneumatic activation mechanism is configured to actuate the at least one multi-directional wheel between the first fixed position and the second fixed position.

10. The wheeled lifting device according to claim 8, further comprising a clamping device configured to attach the pneumatic activation mechanism to the frame of the wheelchair.

11. The wheeled lifting device according to claim 1, wherein the extension mechanism comprises a hydraulic activation mechanism operatively coupled to the at least one multi-directional wheel.

12. The wheeled lifting device according to claim 11, wherein the hydraulic activation mechanism is configured to actuate the at least one multi-directional wheel between the first fixed position and the second fixed position.

13. The wheeled lifting device according to claim 11, further comprising a clamping device configured to attach the hydraulic activation mechanism to the frame of the wheelchair.

* * * * *